US005386180A

United States Patent [19]

Nakajima et al.

[11] Patent Number: 5,386,180

[45] Date of Patent: Jan. 31, 1995

[54] STROBO APPARATUS

[75] Inventors: Yukio Nakajima, Okaya; Muneaki Yoshida, Hachioji; Hiroshi Yamada, Hachioji; Satoshi Kawakami, Hachioji, all of Japan

[73] Assignee: Olympus Optical Co., Ltd., Tokyo, Japan

[21] Appl. No.: 33,055

[22] Filed: Mar. 10, 1993

Related U.S. Application Data

[63] Continuation of Ser. No. 642,239, Jan. 16, 1991, abandoned.

[30] Foreign Application Priority Data

| | | | |
|---|---|---|---|
| Jan. 17, 1990 | [JP] | Japan | 2-8589 |
| Jan. 29, 1990 | [JP] | Japan | 2-20000 |
| Jun. 5, 1990 | [JP] | Japan | 2-147600 |
| Sep. 4, 1990 | [JP] | Japan | 2-235073 |

[51] Int. Cl.[6] ..... H05B 37/02

[52] U.S. Cl. ..... 315/241 S; 315/151

[58] Field of Search ..... 315/241 P, 241 R, 241 S, 315/151; 257/356; 307/499, 544, 546

[56] References Cited

U.S. PATENT DOCUMENTS

| | | | |
|---|---|---|---|
| 3,789,503 | 2/1974 | Nishida et al. | 257/356 |
| 4,258,290 | 3/1981 | Nakajima | 315/135 |
| 4,258,297 | 3/1981 | Nakajima | 315/241 |
| 4,274,724 | 6/1981 | Nakajima | 354/33 |
| 4,363,542 | 12/1982 | Kondo et al. | 354/31 |
| 4,444,483 | 4/1984 | Nakajima | 354.1/128 |
| 4,847,538 | 7/1989 | Iwata et al. | 315/241 P |

*Primary Examiner*—Robert J. Pascal
*Assistant Examiner*—Michael B. Shingleton
*Attorney, Agent, or Firm*—Louis Weinstein

[57] ABSTRACT

In this strobo apparatus, in a strobo controlling circuit in which such self-arc extinction-type gate-controlling type switching device as an IGBT is connected in series with a flash discharge tube to control the flash of the discharge tube, a bias voltage controlling the on/off operation of the above-mentioned gate-controlling type switching device is obtained from a biasing condenser charged with an exciting current of the flashing discharge tube or directly from a power source voltage boosting circuit through a resistance or sub-condenser.

53 Claims, 9 Drawing Sheets

STROBO APPARATUS

This is a continuation of application Ser. No. 642,239, filed Jan. 16, 1991 now abandoned.

BACKGROUND OF THE INVENTION

1. Field of the Invention

This invention relates to strobo apparatus and more particularly to a control circuit efficiently flashing and stopping flashing in a strobo apparatus used in photographing or the like.

2. Related Background Arts

As well known, in a flash photography using a strobo apparatus, a flash discharge tube is made to flash toward an object to be photographed and the flash is stopped at the time when the most suitable exposure value is reached. Also, in order to control the flash of the flash discharge tube of the above mentioned strobo-apparatus, it has been general to connect a thyristor as a semiconductor switching device in series with a flash discharge tube to control switching on/off the conduction of the thyristor.

However, the conventional thyristor controlled type strobo circuit has in defects that an arc making circuit for switching on the thyristor and an arc extinction commutating circuit for switching off the thyristor are respectively required and the circuits are complicated and costly.

Therefore, in order to eliminate these defects, there is provided a strobo controlling circuit (See the specification of U.S. Pat. No. 4,839,686) using such gate controlling type switching device as a recently practiced insulated gate bipolar transistor (abbreviated as IGBT hereinafter) instead of the thyristor.

As compared with the conventional strobo controlling circuit using a thyristor, this strobo controlling circuit using a gate controlling type switching device has a feature that, as it uses a self-arc extinction type device which is a function of the device itself, no commutating circuit is required. However, in order to control such controlling device as this IGBT so as to be sufficiently conductive, it is necessary to apply to the gate a voltage of several 10's of volts which are higher than that of the thyristor.

As a means of obtaining such high gate voltage as these several 10's volts, there is already a means shown in a strobo controlling circuit using such IGBT as is disclosed in the specification of U.S. Pat. No. 4,839,686. In this controlling circuit, as shown in FIG. 16 incorporated herein a voltage boosting coil S is attached to a battery power source voltage boosting circuit 200 for high voltage charging a main condenser C so that an alternating current voltage induced in this coil S may be converted to a constant direct current voltage by a constant voltage circuit 201 comprising a transistor $Q_1$, Zener diode ZD and smoothing condenser $C_1$ of a large capacity to make a voltage of several 10's volts to be applied to the gate and this voltage may be applied to the gate of the IGBT. The above mentioned transistor $Q_2$ is operated to be on by a transister $Q_3$ switched on by a flash starting signal TRIGL issued from a control signal generating circuit 202. When a flash stopping signal STOPL is issued from the above-mentioned signal generating circuit 202, transistors $Q_4$ and $Q_5$ will be on and the above-mentioned transistors $Q_2$ and $Q_3$ will be off so that the application of the gate voltage to the IGBT may be removed.

Also, in this strobo controlling circuit, a trigger transformer T for applying a high trigger voltage to the trigger electrode of a discharge tube Xe is connected to the collector of the IGBT connected in series with the above-mentioned flashing discharge tube Xe so that, when the IGBT is conductive, the trigger condenser C2 will be charged and a high voltage will be induced in the trigger transformer T and will be applied to the trigger electrode.

On the other hand, a strobo controlling circuit using a well known FET (field effect type transistor) as a gate-controlling type switching device is also disclosed in the specification of U.S. Pat. No. 4,847,538 but, in this controlling circuit, too, exactly the same means as the means for obtaining the gate voltage of the above-mentioned IGBT is adopted for the gate voltage of the FET connected in series with the flashing discharge tube.

However, in a strobo controlling circuit using such gate-controlling type device as the above-mentioned IGBT or FET, as the voltage to be applied to the gate electrode is obtained by utilizing the strobo power source voltage boosting circuit 200 as described above, there are defects of complicating the circuit, a high number of component parts and a high cost that:

(1) An intermediate tap must be provided to attach the voltage boosting coil S to the secondary side winding of the voltage boosting transformer;

(2) The constant voltage circuit 201 comprising the transistor $Q_1$, Zener diode ZD and smoothing sub-condenser $C_1$ of a large capacity must be provided in order that the alternating current voltage induced in the voltage boosting coil S may be made a stable voltage of several 10's volts to be applied to the gate; and (3) The gate circuit 203 comprising a plurality of high voltage resistant switching transistors $Q_2$, $Q_3$, $Q_4$ and $Q_5$ is necessary to retain the voltage to the gate electrode.

Further, after the main condenser C is charged, until a flash starting signal is input, the voltage necessary for the gate bias of the IGBT must be retained in the sub-condenser $C_1$. Otherwise, the IGBT will not be on, therefore the discharge tube Xe will not flash or the IGBT will be likely to be broken by the short of the gate bias. Therefore, in consideration of being left for a long time, a condenser of less leakage than the main condenser and of a high precision and large capacity is required for the sub-condenser $C_1$. The cost is high and a large fitting space is required. These are some of the problems encountered

SUMMARY AND OBJECT OF THE INVENTION

Objects of the Invention

An object of this invention is to provide a strobo apparatus wherein the above-mentioned conventional defects in a strobo controlling circuit using such gate-controlling type switching device as an IGBT are eliminated, no condenser of a large capacity is required for the complicated gate driving power source circuit and the gate bias of an IGBT, component parts are few in number and the structure is very simple.

BRIEF DESCRIPTION OF THE INVENTION

According to the present invention, in a strobo controlling circuit by using such self-arc extinction type gate-controlling type switching device as an IGBT, a bias voltage of the above-mentioned switching device is obtained by utilizing an exciting current of a flash discharge tube or through a resistance from a high voltage circuit, therefore it is not necessary to provide independently from a voltage boasting circuit a power source for biasing a gate electrode of the above-mentioned switching device as in a conventional controlling circuit of this kind, a commutating diode for the biasing power source, smoothing sub-condenser of a large capacity and constant voltage device are not required.

Therefore, according to the present invention, a very simple strobo controlling circuit from which conventional defects are removed can be provided.

DETAILED DESCRIPTION OF PREFERRED EMBODIMENTS

Figure 1:
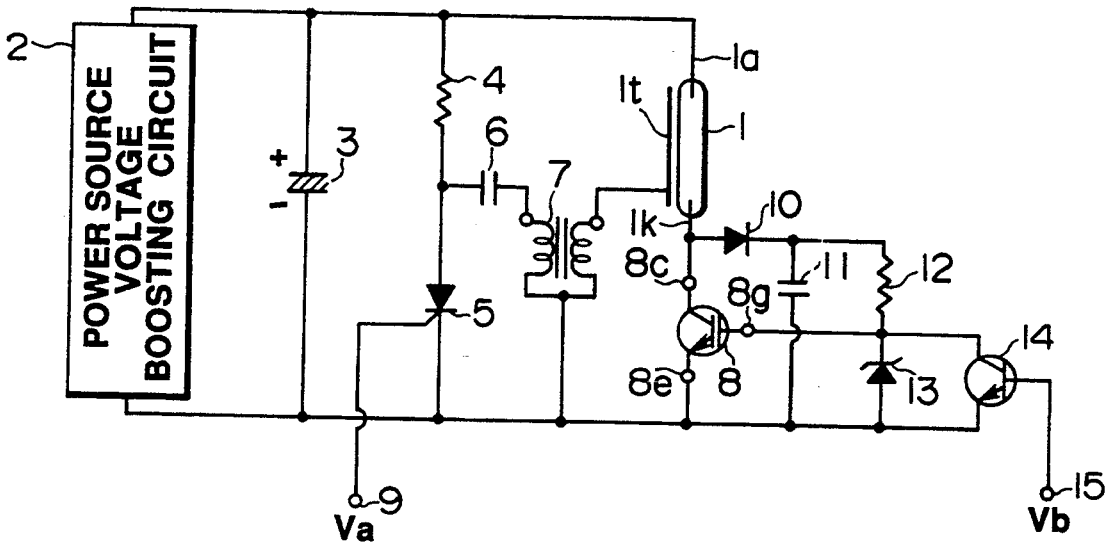
FIG. 1 is an electric circuit diagram of a controlling circuit of a strobo apparatus showing the first embodiment of the present invention.

FIG. 1 is a controlling circuit diagram of a strobo apparatus of the first embodiment of the present invention wherein to a power source voltage boosting circuit 2 for feeding a high voltage required for the discharge of a flashing discharge tube 1 are connected at both ends a main condenser 3 for storing an electric charge fed from the voltage boosting circuit 2, a series circuit of a resistance 4 and thyristor 5 and a series circuit of the above-mentioned flash discharge tube 1 and a gate-controlling type first switching device 8.

When a flash starting signal is applied to the gate from an input terminal 9, the above-mentioned thyristor 5 will be on to operate a trigger means comprising a trigger condenser 6 connected at one end to a connecting point of the above-mentioned resistance 4 and thyristor 5 and at the other end to the primary winding of a trigger transformer 7, the trigger transformer 7 having the secondary winding connected to a trigger electrode It of the above-mentioned discharge tube 1 and generating an exciting high voltage pulse for the electrode 1t and the above-mentioned thyristor 5 which, when switched on, will discharge through the primary winding the charged electric charge accumulated in the above-mentioned condenser 6.

The above-mentioned gate-controlling type first switching device 8 is such self-arc extinction-type gate-controlling type switching device which will be conductive between a collector 8*c* and emitter 8*e* when a bias voltage is applied to a gate electrode 8*g* but will be non-conductive when the voltage application to the gate electrode 8*g* is interrupted as concretely an IGBT or power FET.

A biasing condenser 11 is connected in parallel through a reverse flow preventing diode 10 between the collector 8*c* and emitter 8*e* of this first switching device 8. A voltage dividing circuit consisting of a series circuit of a resistance 12 and Zener diode 13 is connected in parallel with the condenser 11. A transistor which is the second switching device 14 is connected in parallel with the Zener diode 13.

The above-mentioned biasing condenser 11 is a condenser for storing a gate biasing charge of the first switching device 8 and forms a self-biasing circuit applying a bias voltage to the gate electrode 8*g* through a resistance 12.

The above-mentioned reverse flow preventing diode 10 charges the above-mentioned biasing condenser 11 with the discharge current of the discharge tube 1 and acts to prevent the charge of the biasing condenser 11 from being discharged through the first switching device 8 even after it is conductive. The above-mentioned Zener diode 13 is provided to obtain a voltage which is sufficient for the conduction and is not broken by the gate electrode 8*g*.

On the other hand, the above-mentioned second switching device 14 is to be on when a flash stopping signal is applied to the base electrode from an input terminal 15 when the flash is stopped and is to keep the gate electrode 8*g* of the first switching device 8 below the voltage at which the device 8 becomes non-conductive.

Figure 2:
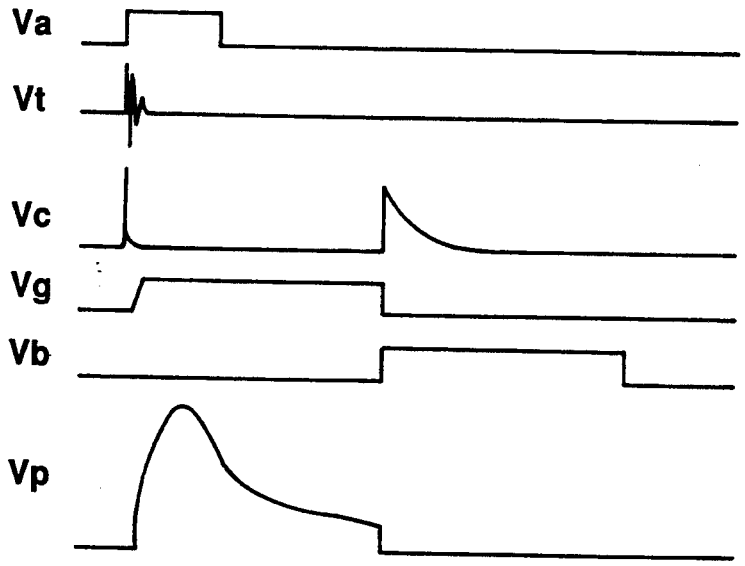
FIG. 2 is a time chart of the operation of the controlling circuit of the above-mentioned first embodiment.

The operation of the controlling circuit of the thus formed first embodiment shall be explained in the following with the time chart shown in FIG. 2. First of all, when a power source switch not illustrated is switched on, the main condenser 3 will be charged from the power source voltage boosting circuit 2 with a voltage sufficient for the flashing discharge tube 1 to emit discharge light. In this state, the trigger condenser 6 is also charged with the same voltage through the resistance 4 and the primary winding of the trigger transformer 7.

In this state, in starting the strobo flash, when a flash starting signal Va having a voltage necessary to turn on the thyristor 5 is applied to the input terminal 9, the thyristor 5 will be on and the charge of the trigger condenser 6 will be discharged through the primary winding of the trigger transformer 7. Then, a high trigger pulse voltage Vt will be generated in the secondary winding of the trigger transformer 7 and will be applied to the trigger electrode it of the discharge tube 1. When a high voltage pulse is applied to the trigger electrode 1t, the discharge tube 1 will be excited to be conductive. Then, the first switching device 8 will not yet be conductive, the electric current discharged through the discharge tube 1 from the main condenser 3 will flow to the biasing condenser 11 through the reverse flow preventing diode 10 to charge the condenser 11. Then, the voltage of the condenser 11 at both ends will rise accordingly and therefore the voltage Vc between the emitter 8*e* and gate electrode 8*g* of the first switching device 8 will rise through the resistance 12 to turn on the first switching device 8. The conductive impedance of the discharge tube 1 is so low that the operation so far will be made usually within several μ (Micro) seconds.

With charging the biasing condenser 11, the voltage of the cathode 1*k* of the discharge tube 1 will once rise but the discharge tube 1 once excited will become active and will continue to be conductive within 100 μ seconds. Therefore, when the first switching device 8 turns on within several μ seconds and becomes conductive between the collector 8*c* and emitter 8*e*, the discharged current of the discharge tube 1 will flow from the collector 8*c* to the emitter 8*e* of the switching device 8 and the discharge flash of the discharge tube 1 will continue- When the switching device 8 is switched on, the potential Vc of the collector 8*c* will reduce to be below several volts but the charge with which the biasing condenser 11 is once charged will be prevented from being discharged through the switching device 8 by the reverse direction polarity of the diode 10 and will be discharged only through the resistance 12 and Zener diode 13.

Then, in stopping the strobo flash, when a flash stopping signal Vb switching on the second switching device 14 is applied to the other input terminal 15, the switching device 14 will be on and will reduce the potential between the gate electrode 8*g* and emitter 8*e* of the first switching device 8. Being a so-called self-arc extinction type switching device wherein, when the gate potential reduces, the conduction between the collector 8*c* and emitter 8*e* of the first switching device 8 will be interrupted, by the operation of switching on the second switching device 14, the first switching device 8 will become non-conductive between the collector 8*c* and emitter 8*e*.

Therefore, the discharge current of the discharge tube 1 will be interrupted and the discharge flash will be stopped. The flash stopping signal Vb applied to the second switching device 14 will be removed after the arc extinction of the discharge tube 1. By the way, the flash stopping signal is output from a so-called known circuit not illustrated outputting a flash stopping signal when a light current is integrated and a predetermined value is reached, as is well known.

By the way, the Zener diode 13 clamps the voltage between the emitter 8*e* and gate electrode 8*g* of the first switching device 8 and acts to prevent the gate electrode 8 from being broken but will not be required if the breaking voltage of the gate electrode 8*g* of the first switching device 8 is above the charging voltage of the main condenser 3.

A gate insulating type switching device will be on when a voltage is only applied to the gate and even if a current flows, therefore the biasing condenser 11 may apply a voltage to the gate of the first switching device 8 only during the discharge of the discharge tube 1 and therefore the capacity may be very small.

Figure 3:
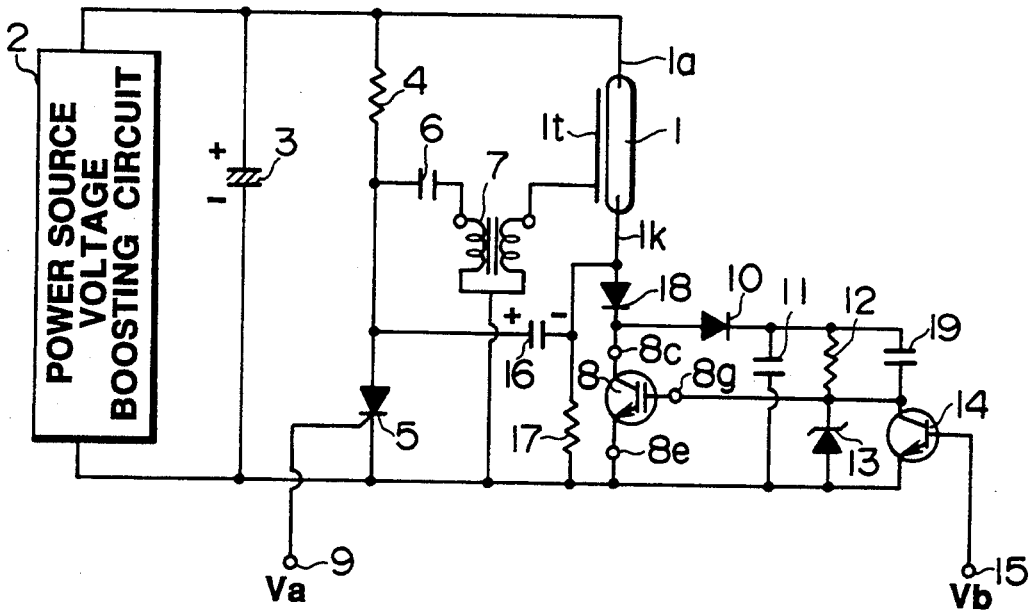
FIG. 3 is an electric circuit diagram of a controlling circuit of a strobo apparatus showing a second embodiment of the present invention.

FIG. 3 shows a controlling circuit diagram of a strobo apparatus of the second embodiment of the present invention. In this controlling circuit of the second embodiment, a double voltage circuit and speed up condenser 19 are added to the controlling circuit of the above-mentioned first embodiment and the other connections are exactly the same as in the circuit of the above-mentioned first embodiment. Therefore, the same component parts shall bear the same reference numerals and shall not be explained here.

That is to say, the above-mentioned voltage doubling circuit comprises a voltage doubling condenser 16 connected at one end to the connecting point of the above-mentioned resistance 4 and thyristor 5 and at the other end to the cathode 1*k* of the flashing discharge tube 1 and a resistance 17 connected between the cathode 1*k* and earth. The speed up condenser 19 is connected in parallel with the above-mentioned resistance 12.

When the thyristor 5 is turned on, the above-mentioned double voltage condenser 16 will apply a voltage substantially double the charging voltage of the main condenser 3 to the discharge tube 1 at both ends so that, even if the charged voltage of the main condenser 3 is low, the discharge may be easy.

In the circuit of this second embodiment, when the thyristor 5 is off, the trigger condenser 6 and double voltage condenser 16 will be respectively charged with a voltage equal to the charged voltage of the main condenser 3.

In this state, when a flash starting signal is applied to the input terminal 9, the thyristor 5 will be on, will apply an exciting high voltage pulse to the trigger electrode 1*t* of the discharge tube 1 and will pull down the cathode 1*k* of the discharge tube 1 to a minus potential. When the discharge tube 1 is thus excited, the discharge tube 1 will be conductive between the anode la and cathode 1*k*. When the discharge tube 1 is conductive, the cathode 1*k* will instantaneously be of a plus potential from a minus potential and the biasing condenser 11 will be charged with the current having flowed through the discharge tube 1. Thereafter, the operation from turning on to turning off of the first switching device 8 is as explained on the circuit of the above-mentioned first embodiment.

By the way, the above-mentioned speed up condenser 19 is to prevent the delay in the rise of the gate voltage of the switching device 8 and the delay in turning on of the switching device 8 by a time constant circuit of the capacity between the emitter 8*e* and gate electrode 8*g* of the first switching device 8 and the resistance 12 and is a condenser of a capacity of a very small value.

Also, in the circuit of this second embodiment, a diode 18 is connected between the cathode 1*k* of the discharge tube 1 and the collector 8*c* of the first switching device 8 and is to prevent that, when the thyristor 5 is on and the cathode 1*k* of the discharge tube 1 is pulled to a minus potential by the charge voltage of the double voltage condenser 16, the collector 8*c* of the switching device 8 will be of the same potential and the device 8 will be broken but, if the breaking voltage of the collector 8*c* of the-device 8 is large enough, this diode 18 will not be necessary.

Figure 4:
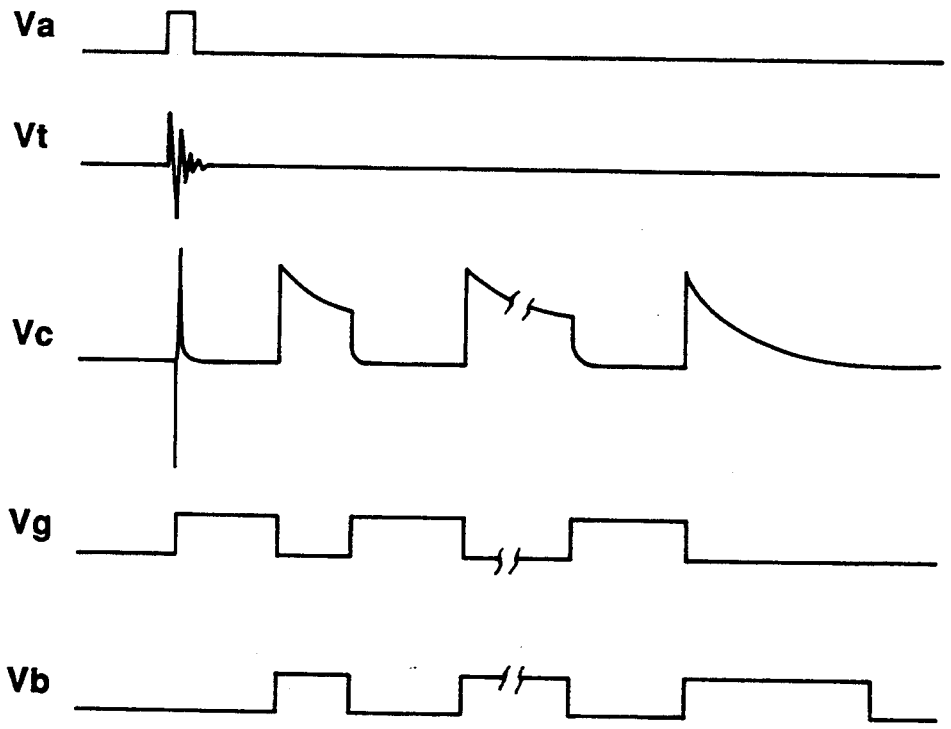
FIG. 4 is a time chart of a continuous flash by the intermittent operation of the controlling circuit of the above-mentioned second embodiment.

FIG. 4 shows a timing chart in the case that, in the controlling circuit of the second embodiment in the above-mentioned FIG. 3, a repeating pulse signal is applied to the other input terminal 15 to continuously emit light by a so-called intermittent operation.

In this continuous flash, at the time of starting the flash, the operation until the flash starting signal Va is applied to one input terminal 9 to start the flash of the discharge tube 1 is as described above. In interrupting the flash, the current of the flash stopping signal Vb is applied to the input terminal 15, the second switching device 14 is switched on, the gate potential of the first switching device 8 is reduced and the device 8 is switched off to interrupt the discharge. However, when the first switching device 8 is switched off, the collector potential Vc of the device 8 will rise and thereby the biasing condenser 11 will be charged again. Even if the current is interrupted, the discharge tube 1 will not immediately become inactive. Therefore, while it is active, the voltage applied to the other input terminal 15 is returned to "L" again and the second switch device 14 is switched off. Then, the gate potential Vg of the first switching device 8 will rise again under the charge voltage of the biasing condenser 11, the switching device 8 will turn on and the discharge will be resumed.

Thus, even in the case of intermittently repeating the discharge in a short period, by only applying to the input terminal 15 such repeating pulse Vb as is shown in FIG. 4, a continuous strobo flash will be able to be made.

Figure 5:
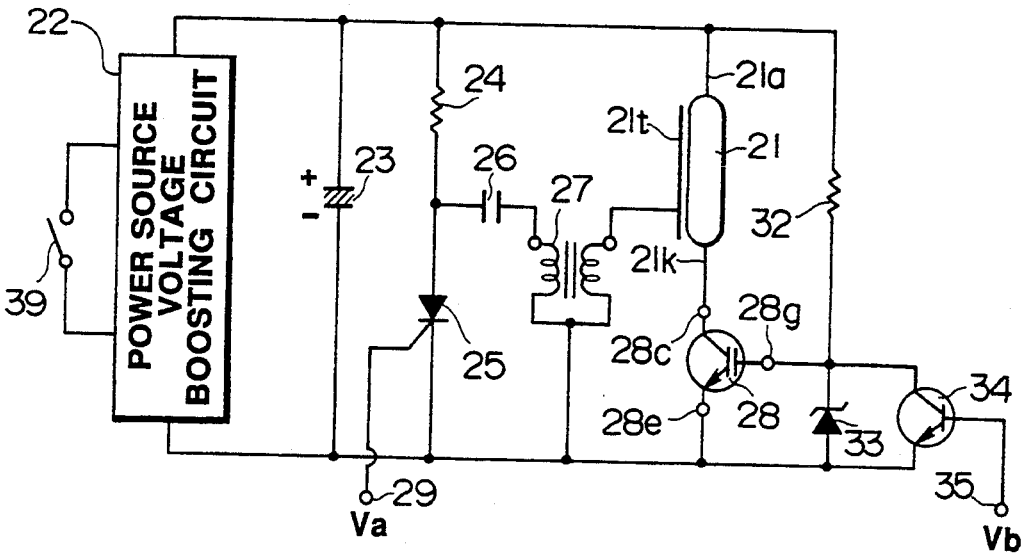
FIG. 5 is an electric circuit diagram of a controlling circuit of a strobo apparatus showing a third embodiment of the present invention.

FIG. 5 is a controlling circuit diagram of a strobo apparatus of the third embodiment of the present invention. In this circuit, too, a main condenser 23 storing an electric charge fed from a power source voltage boosting circuit 22, a series circuit of a resistance 24 and thyristor 25 and a series circuit of a light emitting discharge tube 21 and gate-controlling type first switching device 28 are respectively connected to the power source voltage boosting circuit 22 for feeding a high voltage required for the discharge of the flashing discharge tube 21 at both ends. In this circuit, further a series circuit of a resistance 32 and Zener diode 33 is connected.

The above-mentioned gate-controlling type first switching device 28 is formed of the same IGBT or power FET as is used in the above-mentioned embodiment and is a self-arc extinction-type gate-controlling type switching device wherein the collector **28*c* and emitter 28*e* will be conductive between them when a bias voltage is applied to the gate electrode 28*g* but will be non-conductive when the voltage application to the gate electrode 28*g*** is interrupted.

A trigger circuit comprises a trigger condenser 26 connected at one end to the connecting point of the above-mentioned resistance 24 and thyristor 25 and at the other end to the primary winding of a trigger transformer 27, the trigger transformer 27 having the secondary winding connected to a trigger electrode **21*t* of the above-mentioned discharge tube 21 and the above-mentioned thyristor 25 which, when switched on, will discharge through the primary winding of the above-mentioned trigger transformer 27 the charge accumulated in the above-mentioned condenser 26**.

The above-mentioned biasing resistance 32 is connected at one end to the positive pole of the above-mentioned main condenser 23 and at the other end to the gate electrode **28*g* of the above-mentioned first switching device 28 and forms a bias circuit applying a bias voltage to the gate electrode 28*g*. The above-mentioned Zener diode 33 is connected in parallel between the gate electrode 28*g* and emitter electrode 28*e* of the first switching device 28 and obtains a voltage sufficient for the conduction to the gate electrode 28*g* of the switching device 28 and not broken by the gate electrode 28*g***.

A second switching device 34 consisting of a switching transistor is connected to the above-mentioned Zener diode 33 so as to be switched on when a flash stopping signal is applied to the base electrode from the input terminal 35 at the time of stopping the flash and to hold the gate electrode **28*g* of the first switching device 28** below the voltage at which the device becomes non-conductive.

Figure 6:
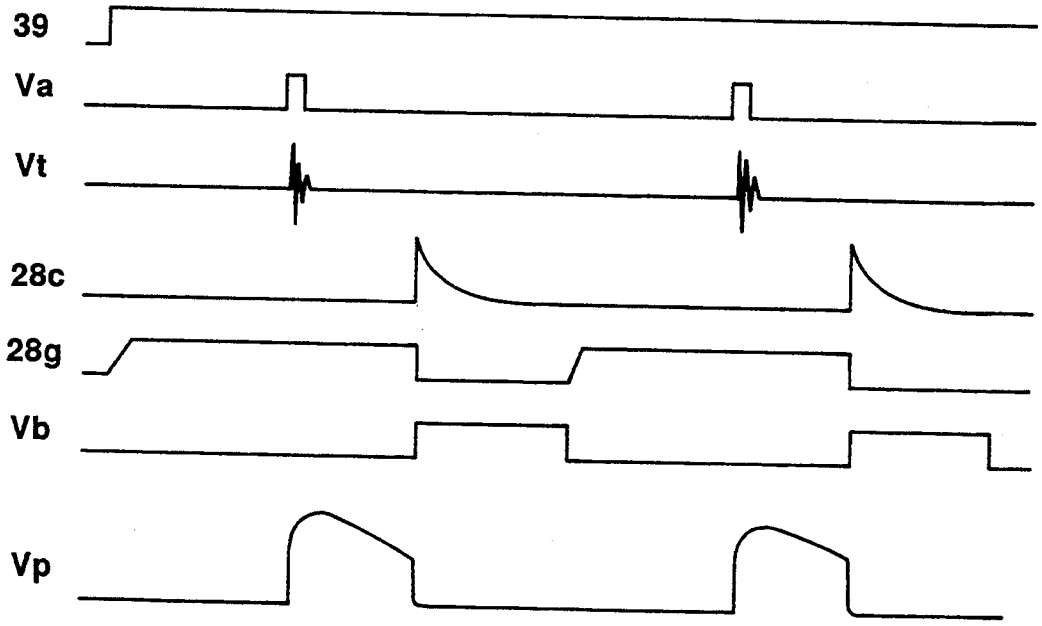
FIG. 6 is a time chart of the operation of the controlling circuit of the above-mentioned third embodiment.

The operation of the controlling circuit of the thus formed third embodiment shall be explained in the following with the time chart shown in FIG. 6. First of all, when the power source switch 39 is switched on, the main condenser 23 will be charged with a voltage sufficient for the flashing discharge tube 21 to discharge and flash from the power source voltage boosting circuit 22. When the voltage of this main condenser 23 at both ends rises, a gate biasing voltage will be applied to the gate electrode **28*g* of the first switching device 28 through a biasing resistance 32 and the first switching device 28 will be conductive. In this state, the trigger condenser 26 will be also charged with the same voltage through the resistance 24 and the primary winding of the trigger transformer 27. In this state, the first switching device 28 will be conductive but the discharge tube 21** will be non-conductive and therefore no flash will be made.

In starting a strobo flash in this state, when a flash starting signal Va having a voltage required to turn on the thyristor 25 is applied to the input terminal 29, the thyristor 25 will be on and the charge of the trigger condenser 26 will be discharged through the primary winding of the trigger transformer 27. Then, a high trigger pulse voltage Vt will be generated in the secondary winding of the trigger transformer 27 and will be applied to the trigger electrode **21*t* of the discharge tube 21. When a high voltage pulse is applied to the trigger electrode 21*t*, the discharge tube 21 will be excited to be conductive. At this time, as the first switching device 28 is already conductive as described above, the discharge current of the discharge tube 21 will flow from the collector 28*c* to the emitter 28*e* of the switching device 28 and a discharge flash Vp of the discharge tube 21** will be made.

Then, in stopping the strobo flash, when a flash stopping signal Vb switching on the second switching device 34 is applied to the other input terminal 35, the switching device 34 will be switched on and will reduce the potential between the gate electrode **28*g* and emitter 28*e* of the first switching device 28. As the first switching device 28 is a so-called self-arc extinction type switching device wherein, when the gate potential reduces, the conduction between the collector 28*c* and emitter 28*e* will be interrupted, by the operation of switching on the second switching device 34, the first switching device 28 will become non-conductive between the collector 28*c* and emitter 28*e*, therefore the discharge current of the discharge tube 21** will be interrupted and the discharge flash will be stopped.

Also, in this embodiment, a Zener diode 33 clamps the voltage between the emitter **28*e* and gate electrode 28*g* of the first switching device 28 and acts to prevent the gate electrode 28*g*** from being broken but will not be required if the breaking voltage of the gate electrode 28g of the first switching device 28 is above the charging voltage of the main condenser 23.

When a voltage is only applied to the gate electrode, even if the current does not flow as in a bipolar transistor, such power gate insulating type switching device will be on but, on the other hand, will reduce the saturated voltage when it is on. Therefore, the device area is large and the gate distribution capacity is generally so large as to be several thousand pF. Therefore, in case a bias voltage is applied to the gate electrode through a resistance, no current will flow through the gate and therefore the resistance value of the biasing resistance may be made large. However, in a system wherein the first switching device is switched on as synchronized with the flash start as in the prior art example, there have been problems that, if the resistance value is made large for the gate distribution capacity, the gate biasing voltage will be delayed in rising and the triggering operation of the trigger circuit will not be well made and, as the saturated voltage of the first switching device does not sufficiently reduce, the switching device will be broken.

However, in this embodiment, prior to starting a flash, the main condenser 23 is charged and a voltage is applied to the gate electrode and, therefore, even if the resistance value of the biasing resistance is made large, there will be no such problems and a complicated gate controlling circuit using a transistor and a gate biasing power source circuit of a large capacity need not be used.

Figure 7:
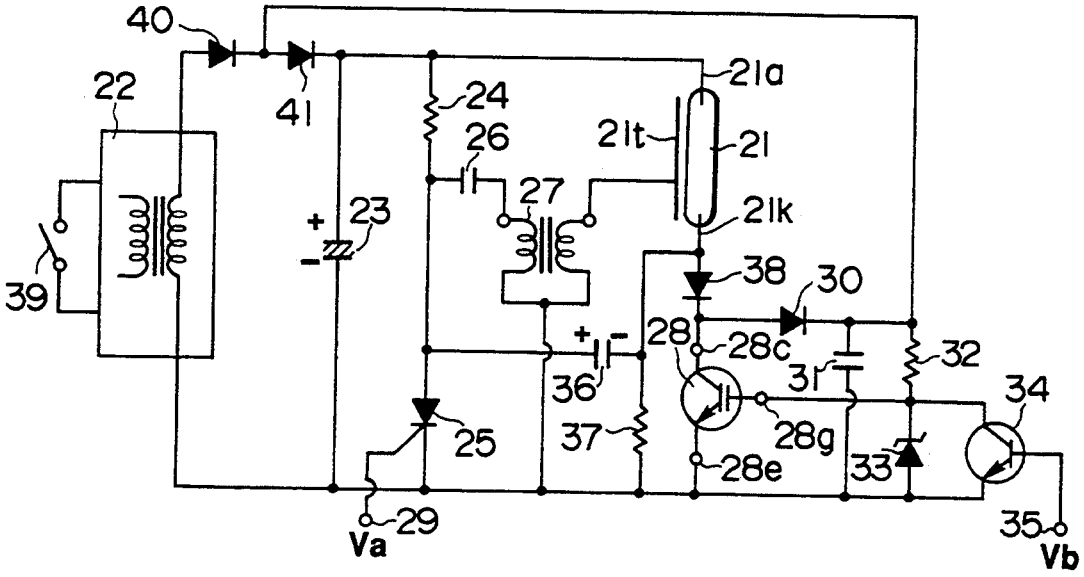
FIG. 7 is an electric circuit diagram of a controlling circuit of a strobo apparatus showing a fourth embodiment of the present invention.

FIG. 7 is a controlling circuit diagram of a strobo apparatus of the fourth embodiment of the present invention. In this controlling circuit of the fourth embodiment, a double voltage circuit is added to the controlling circuit of the above-mentioned third embodiment and a gate biasing power source condenser 31 is provided separately from the main condenser 23. The other connections are substantially the same as in the above-mentioned circuit of the third embodiment. Therefore, the same component parts shall bear the same reference numerals and shall not be explained here.

That is to say, the above-mentioned double voltage circuit comprises a double voltage condenser 36 connected at one end to the connecting point of the above-mentioned resistance 24 and thyristor 25 and at the other end to the cathode 21k of the light emitting discharge tube 21 and a resistance 37 connected between the cathode 21k and earth.

On the other hand, the gate biasing power source circuit comprises a gate power source condenser 31 connected at one end to the cathode side of a commutating diode 40 having an anode connected to the output end of the voltage boosting circuit 22 and at the other end to the earth and a diode 30 having the cathode connected to the connecting point of the cathode of the diode 40 and the condenser 31 and having the anode connected to the collector 28c of the first switching device 28.

When the thyristor 25 is on, the above-mentioned double voltage condenser 36, together with main condenser 23, will apply a voltage substantially twice as large as the charge voltage of the main condenser 23 to the discharge tube 21 at both ends so that, even if the charge voltage of the main condenser 23 is low, the discharge may be easy.

In this circuit of the fourth embodiment, when the main condenser 23 and the bias power source condenser 31 are both charged and a bias voltage is applied to the gate of the first switching device 28 through a resistance 32, the first switching device 28 will be on prior to the flashing operation.

In case the operation of the voltage boosting circuit 22 stops, the diode 41 will prevent the charge of the main condenser 23 from being discharged through the gate biasing resistance 32.

When the thyristor 25 is off, the trigger condenser 26 and double voltage condenser 36 will be respectively charged with a voltage equal to the charge voltage of the main condenser 23.

When a light emission starting signal is applied to the input terminal 29 in this state, the thyristor 25 will be on, will apply an exciting high voltage pulse to the trigger electrode 21t of the discharge tube 21 and will pull down the cathode 21k of the discharge tube 21 to a minus potential. When the discharge tube 21 is thus excited, the discharge tube 21 will be conductive between the anode 21a and cathode 21k. When the discharge tube 21 is conductive, as the first switching device 28 is already on, the discharge current from the main condenser 23 will flow through the discharge tube 21, diode 38 and first switching device 28 and the discharge tube 21 will flash. Thereafter, the operation when the flash is stopped and the operation until the first switching device 28 is turned off are as explained for the above-mentioned circuit of the third embodiment.

In this circuit of the fourth embodiment, the diode 38 is connected between the cathode 21k of the discharge tube 21 and the collector 28c of the first switching device 28 so that, when the thyristor 25 is on, by the charge voltage of the double voltage condenser 36, the cathode 21k of the discharge tube 21 will be pulled to a minus potential, then the collector 28c of the switching device 28 will be of the same potential and the device 28 will be prevented from being broken. However, if the breaking voltage of the collector 28 of the device 28 is large enough, the diode 38 will not be required.

Figure 8:
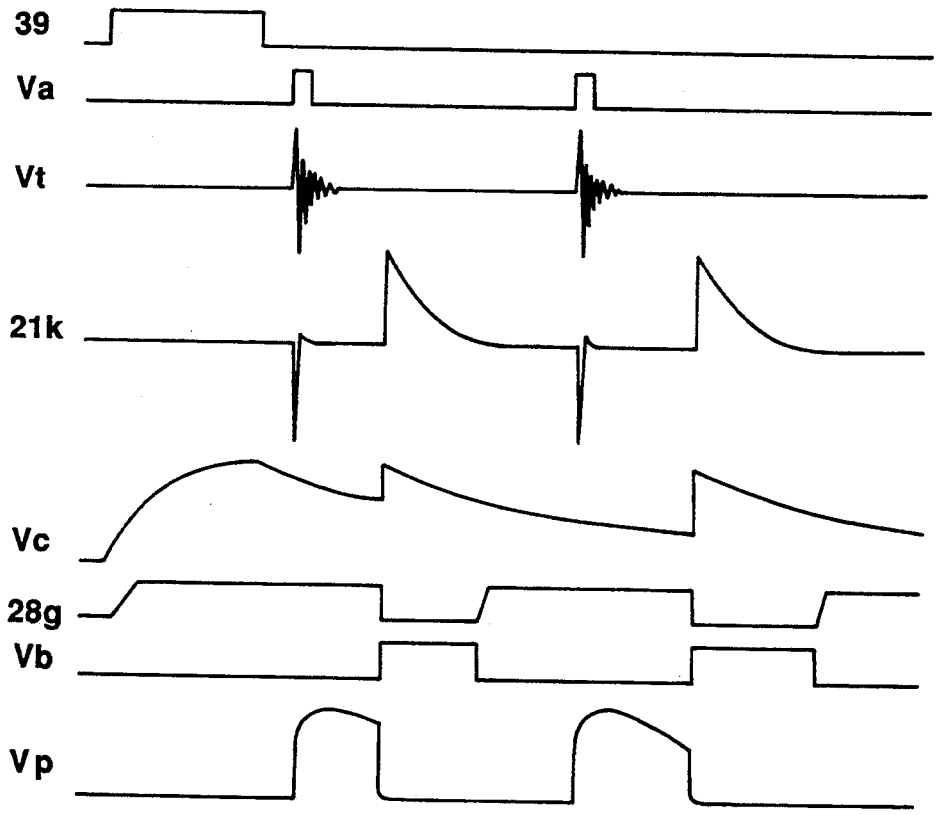
FIG. 8 is a time chart of the operation at the time of the intermittent strobo flash in the controlling circuit of the above-mentioned fourth embodiment.

FIG. 8 shows a timing chart in the case that, in the above-mentioned controlling circuit of the fourth embodiment in FIG. 7, a repeated pulse signal is applied to the input terminals 29 and 35 and a repeated flash is made for a comparatively short period to prevent the generation of a red eye phenomenon.

In the intermittent flash by this intermittent operation, it is as described above that, at the time of starting the flash, a flash starting signal Va is applied to one input terminal 29 and the discharge tube 21 starts the flash. In interrupting the flash, the voltage of a flash stopping signal Vb is applied to the input terminal 35, the second switching device 34 is switched on, the gate potential of the first switching device 28 is reduced and the device 28 is switched off to interrupt the discharge. However, when the first switching device 28 is switched off, the collector potential Vc of the device 28 will rise and thereby the gate biasing power source condenser 31 will be charged again through the diodes 38 and 30. Even if the current is interrupted, the discharge tube 21 will remain active. Therefore, if an 'H' level voltage is applied to the terminal 35 while the discharge tube 21 is active and is returned to an "L" level voltage when it becomes inactive, the second switching device 34 will be switched off, a biasing voltage will be applied again to the gate 28g of the first switching device 28 and the switching device 28 will be switched on again. Then, the gate potential Vg of the first switching device 28 will rise again with the charge voltage of the gate biasing power source condenser 31 and the switching device 28 will turn on. If the "H" level signal is given again to the terminal 29 at the next flashing timing, a trigger signal will be added to the discharge tube 21 which will be excited to make a discharge flash again. Thereafter, the discharge stopping operation is made the same as the first operation. Generally, in case a strobo apparatus makes a charging operation, it will consume such large power source current that, when a release button of a camera is pushed to start a photographing operation, the power source switch 39 of the strobo apparatus will be switched off. Then, the charge of the gate biasing power source condenser 31 will be discharged through the biasing resistance 32 but, in case a flash is continuously repeatedly made, whenever the discharge is stopped, the condenser 31 will be charged and therefore the capacity of the condenser 31 will be able to be made small.

Thus, according to the above-mentioned strobo controlling circuit, a red eye preventing pre-flash for for reducing a red eye phenomenon can be made before the main flash at the time of a flash synchronized photographing. In the means for preventing the red eye phenomenon of an object to be photographed, at the time of a strobo photographing as well known, before the main flash, a plurality of small flashes are made toward the object so that the pupil of the eye of the object may be throttled and thereby the red eye phenomenon may be reduced. According to the above-mentioned flashing circuit, this pre-flash can be made.

Figure 9:
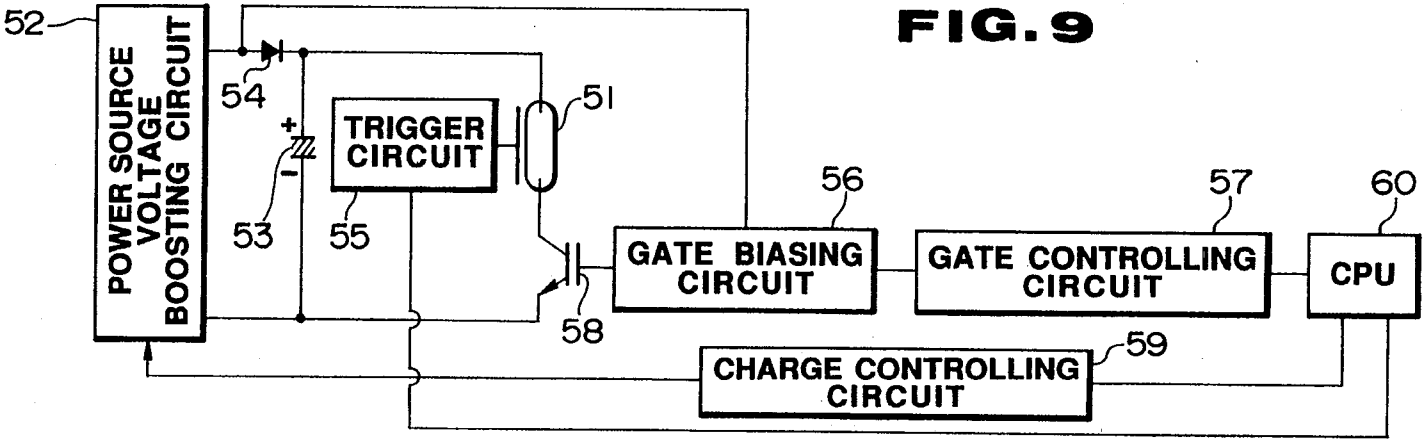
FIG. 9 is a formation block diagram of the controlling electric circuit of the strobo apparatus showing a fifth embodiment of the present invention.

FIG. 9 is a formation block diagram of an electric circuit of a strobo apparatus of the fifth embodiment of the present invention. This strobo controlling circuit of the fifth embodiment comprises a power source voltage boosting circuit 52 having a voltage boosting circuit including a DC-DC converter and feeding a main condenser 53 with a predetermined charge voltage, the main condenser 53 in which is accumulated a charge making a flashing discharge tube 51 flash through a reverse flow preventing diode 54 from this power source voltage boosting circuit 52, an IGBT 58 forming a series circuit with the above-mentioned discharge tube 51, connected to the above-mentioned main condenser 53 and controlling the discharge of the charge with which the condenser 53 is charged, a flash starting trigger circuit 55 exciting the above-mentioned discharge tube 51, a gate biasing circuit 56 including a sub-condenser connected in parallel with the above-mentioned main condenser 53 and having a charge input from the above-mentioned power source voltage boosting circuit 52 and applying a biasing voltage to the gate terminal of the above-mentioned IGBT 58, a gate controlling circuit 57 controlling this gate biasing circuit 56, a charge controlling circuit 59 outputting a control signal for making the above-mentioned power source voltage boosting circuit 52 practice a feeding operation and a CPU 60 controlling the respective operations of the charge controlling circuit 59, the trigger circuit 55 and gate-controlling circuit 57.

In the thus formed strobo controlling circuit of the fifth embodiment, first of all, the main condenser 53 is charged. That is to say, when a charge start controlling signal for practicing a charging operation is output to the power source voltage boosting circuit 52 through the charge controlling circuit 59 from the CPU 60, the voltage boosting circuit including the DC-DC converter will operate and the power source voltage boosting circuit 52 will charge the main condenser 53 with a charge for a spark through the diode 54. At this time, such capacity device as the sub-condenser within the gate biasing circuit 56 will be also charged with an electric charge and thereby the IGBT 58 will be on. However, when the power source voltage boosting circuit 52 is switched off, the charge to this capacity device will be discharged in a short time. When the main condenser 53 reaches a predetermined voltage, the CPU 60 will issue a charge stop controlling signal to stop the operation of the power source voltage boosting circuit 52.

Then, when a flashing signal is received, the CPU 60 will once operate the power source voltage boosting circuit 52, will store an electric charge in the capacity device within the gate biasing circuit 56, will switch on the IGBT 58, then will stop the operation of the power source voltage boosting circuit 52 and will operate the trigger circuit 55. Then, the discharge tube 51 will be excited to flash. In stopping the flash, when a proper exposure is reached, a flash stopping signal will be output to the gate-controlling circuit 57 from the CPU 60 and the controlling circuit 57 will short the gate of the IGTB 58 through the gate biasing circuit 56 to stop the flash.

Also, as a modification of the thus formed embodiment, a red eye preventing pre-flashing operation can be made by using a strobo controlling circuit. That is to say, the feature of the present invention is to apply a gate bias to the IGBT 58 by operating the power source voltage boosting circuit 52 just before the flash of the discharge tube 51 and therefore, by utilizing this feature, when the power source voltage boosting circuit 52 is operated to switch on the IGBT 58 just before the pre-flash, then the power source voltage boosting circuit 52 is switched off and the trigger circuit 55 is operated, the discharge tube 51 will start flashing. If a flash stopping signal is then output from the CPU 60, the discharge tube 51 will stop the flash and therefore the flash of the discharge tube 51 will become small. Therefore, if this pre-flashing operation is continuously repeated a plurality of times, the red eye phenomenon will be able to be reduced.

In this pre-flash, as the power source voltage boosting circuit 52 is started just before every pre-flash, the main condenser 53 will be also charged meanwhile. Therefore, the main condenser in which the voltage has been reduced by one pre-flash can be charged. The voltage with which the main condenser is charged will be small if the time for applying the charge starting signal CHG to the power source voltage boosting circuit 52 is short but will be large if that time is long. Therefore, the application of the charge starting signal CHG will be made long when the light amount of one pre-flash is made large but will be made short in case the flash amount is made small so that the reduction of the voltage of the main condenser at the time of the main flash may be prevented.

In case such red eye preventing pre-flash is made, there will be effects that there will not be produced problems that, at the time of the main flash, the voltage of the main condenser will reduce, the light amount of the main flash will reduce and therefore the photographable distance will reduce.

Figure 10:
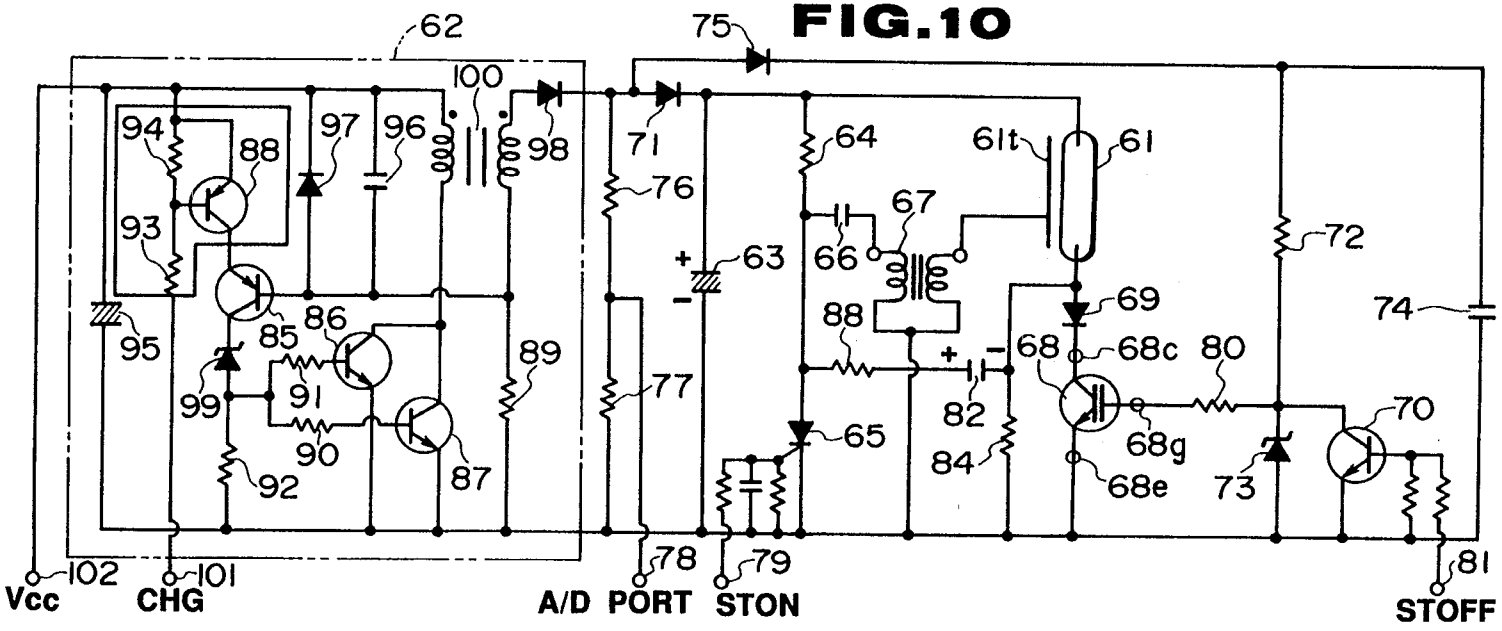
FIG. 10 is an electric circuit diagram of a controlling circuit of a strobo apparatus showing a sixth embodiment of the present invention.

FIG. 10 is a concrete electric circuit diagram of a strobo apparatus of the sixth embodiment of the present invention. In this strobo controlling circuit, a series circuit of a main condenser 63 storing a charge fed from a power source voltage boosting circuit 62, a resistance 64 and a flash starting trigger thyristor 65 and a series circuit of a discharge tube 61, a diode 69 and an IGBT 68 are connected to both ends of the power source voltage boosting circuit 62 for feeding a high voltage necessary for the discharge of the flashing discharge tube 61 through a reverse flow preventing diode 71 of the above-mentioned main condenser 63 and a series circuit of a biasing resistance 72 and a Zener diode 73 restricting the gate voltage of the IGBT and a sub-condenser 74 operate as the biasing gate power source of the above-mentioned IGBT and are connected to the above-mentioned both ends through a reverse flow preventing diode 75. A voltage dividing circuit comprising a series circuit of resistances 76 and 77 and inputting a charge detecting voltage of the main condenser 63 into an A/D port of a CPU (not illustrated) through a terminal 78 is connected to both ends of the power source voltage boosting circuit 62.

The above-mentioned trigger thyristor 65 will be switched on to operate the trigger circuit when a flash starting signal STON is applied to the gate from an input terminal 79. The trigger circuit comprises a trigger condenser 66 connected at one end to the connecting point of the above-mentioned resistance 64 and a thyristor 65 and at the other end to the primary winding of a trigger transformer 67, the trigger transformer 67 having the secondary winding connected to the trigger electrode 61*t* of the above-mentioned discharge tube 61 and generating an exciting high voltage pulse for the same electrode 61*t* and the above-mentioned thyristor 65 discharging, when on, through the primary winding of the above-mentioned trigger transformer 67 the accumulated charge in the above-mentioned condenser 66

The above-mentioned IGBT 68 is a self-arc extinction-type gate-controlling type switching device which will be conductive between the collector 68*c* and emitter 68*e* when a biasing voltage is applied to the gate electrode 68*g* and will be non-conductive when the voltage application to the gate electrode 68*g* is interrupted. A resistance 80 connected at one end to the connecting point of the above-mentioned Zener diode 73 and resistance 72 and is connected at the other end to the gate electrode 68*g*.

The above-mentioned Zener diode 73 is to obtain a voltage sufficient for the conduction to the gate electrode 68*g* of the IGBT 68 and not broken by the gate electrode 68*g*. A switching device transistor 70 shunting the gate of the IGBT 68 is connected in parallel with the Zener diode 73, will be switched on when a flash stopping signal STOFF is applied to the base from an input terminal 81 when the flash is stopped and acts to hold the gate electrode 68*g* of the IGBT 68 below the voltage at which the IGBT 68 becomes non-conductive.

Also, a double voltage circuit is attached to the above-mentioned discharge tube 61. That is to say, this double voltage circuit comprises a series circuit of a double voltage condenser 82 and resistance 83 and a resistance 84. The series circuit is connected to the anode of the above-mentioned trigger thyristor 65 and the anode of the above-mentioned diode 69 with the condenser 82 on the diode 69 side and the resistance 84 is connected in parallel with a series circuit of the above-mentioned diode 69 and IGBT 68. In this double voltage circuit, when the thyristor 65 is switched on, the above-mentioned double voltage condenser 82 will apply a voltage substantially twice as large as the charge voltage of the main condenser 63 to both ends of the discharge tube 61 so that, even if the charge voltage of the main condenser 63 is low, the discharge may be easy.

On the other hand, the above-mentioned power source voltage boosting circuit 62 forms a DC-DC converter and voltage boosting circuit by connecting as illustrated a transistors 85 to 88, resistances 89 to 94, condensers 95 and 96, diodes 97 and 98, Zener diode 99 and a voltage boosting transformer 100 and will operate to generate a predetermined charge voltage at the output end when an operating voltage Vcc is applied to a terminal 102 and a charge starting signal CHG is applied to an input terminal 101.

The charge starting signal CHG, flash starting signal STON and flash stopping signal STOFF applied respectively to the above mentioned respective input terminals 100, 79, and 81 are applied through a controlling circuit from a CPU not illustrated. Also, the A/D port of the CPU is connected to the output terminal 78 and the charge voltage of the main condenser is input into the A/D port.

The operation of the thus formed strobo controlling circuit shall be explained in the following. First of all, when a charge starting signal CHG from the CPU is applied, the power source voltage boosting circuit 62 will start to charge the main condenser 63 and sub-condenser 74. When the main condenser 63 reaches a set voltage, the CPU will interrupt the application of the signal CHG to the terminal 101. Then, the main condenser 63 will hold the charge voltage as it is but, as the sub-condenser 74 is small in capacity and is discharged by, the circuit of the resistance 72 and diode 73, the voltage will drop near to zero in several seconds Then, with the releasing operation, a flash starting signal STON will be applied to start a flash but, just before this flash starting signal STON comes in, for several ms to several 100 ms, a charge starting signal CHG will be applied to operate the power source voltage boosting circuit 62 to charge the sub-condenser 74. When the voltage of this sub-condenser 74 rises, a gate biasing voltage will be applied to the gate of the IGBT 68. As this voltage is restricted by the Zener diode 73, a constant voltage will be applied so that the IGBT 68 may be on. Thereafter, before the charge voltage of the sub-condenser 74 falls below the gate biasing voltage, a flash starting signal STON will be input, the trigger circuit will operate and the discharge tube 61 will start a flash.

When a proper exposure is obtained, a flash stopping signal STOFF will be input into the terminal 81 from the CPU, the switching transistor 70 will be switched on, the gate of the IGBT 68 will be shunted and the flash of the discharge tube 61 will be stopped. That is to say, the flash amount by the discharge tube 61 is proportional to the time until the flash stopping signal STOFF is input after the flash starting signal STON is input.

Figure 11:
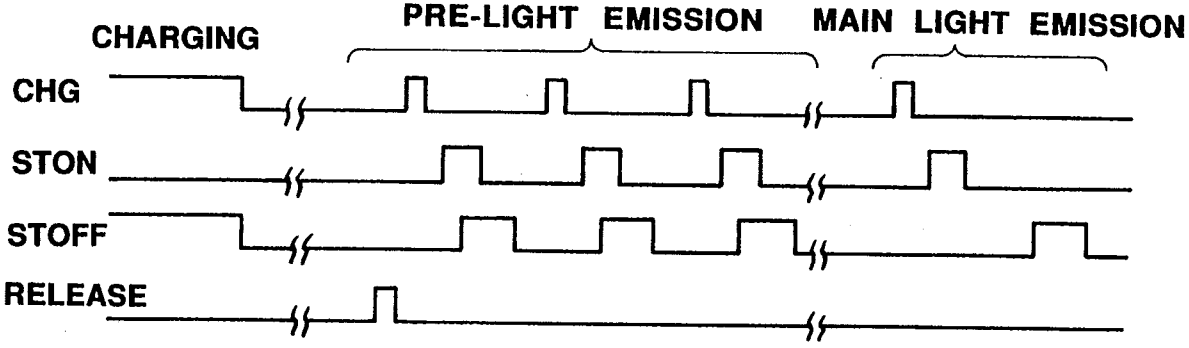
FIG. 11 is a time chart of the operation of the controlling circuit of the above-mentioned sixth embodiment.

This strobo apparatus of the sixth embodiment also can make a pre-flash for preventing a red eye phenomemon the same as in the above-mentioned fifth embodiment. In the case of this red eye reducing flash, a small flashes repeated 10 and several times. In this case, too, as shown in the time chart in FIG. 11, the same as in the modification of the above-mentioned fifth embodiment, just before each pre-flash, a charge starting signal CHG for several ms to several 100 ms will be applied to the terminal 101 to charge the sub-condenser 74. Then, the flash starting signal STON and and flash stopping signal STOFF are repeatedly applied at intervals of a fixed time to make a pre-flashing operation by a continuous small flash to thereby prevent a red eye phenomenon, It is needless to say that, just before the main flash, too, the sub-condenser 74 will be charged in the same manner.

Figure 12:
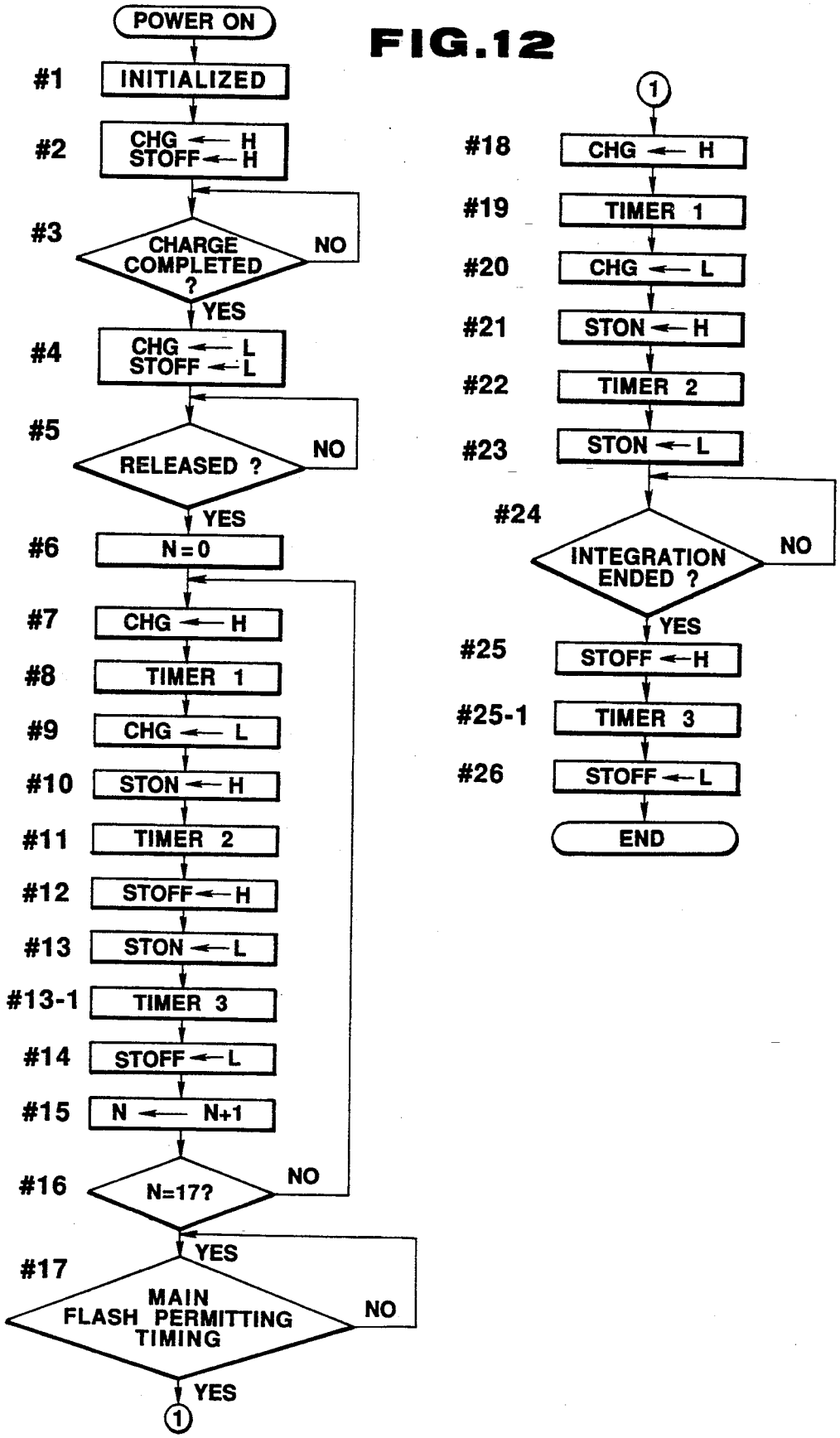
FIG. 12 is a flow chart of the operation of the controlling circuit of the above-mentioned sixth embodiment.

FIG. 12 shows a flow chart of an operation in the case that a main flash is made after a pre-flash for preventing a red eye phenomenon is made.

First of all, the power is switched on, in Step #1, the initialization is made and then, in Step #2, the charge starting signal CHG and flash stopping signal STOFF are set to the "H" level and the power source voltage boosting circuit is operated. Then, in Step #3, the charge completion of the main condenser is checked. If the charge is completed, in Step #4, the charge starting signal CHG and flash stopping signal STOFF are set to the "L" level. Then, in Step #5, it is checked whether the releasing operation of the camera is made or not and, if it is yes, in Step #6, the number of pre-flashes is made N=0, that is, it is initialized. Then, in Step #7, the charge starting signal CHG is set to the "H" level and, after the time set in the timer 1 of Step #8 elapses, in Step #9, the above-mentioned signal CHG is made on the 'L' level and then, in Step #10, the flash starting signal STON is made "H" and the strobo apparatus is made to make a small flash for the time set in the timer 2 of Step #11. Then, in Step #12, the above-mentioned flash stopping signal STOFF is made "H" and further, in Step #13, the above-mentioned starting signal STON is set to the "L" level. Then, in Step #13-1, after the time of the timer 3 elapses, in Step #14, the above-mentioned stopping sigtnal STOFF is made "L" and one small light emission ends. Then, in Step #15, the number of flashes is set at N+1. These Steps #7 to #15 are of one small flashing operation in the pre-flashing operation.

In case a small flash is set to be repeated, for example, 17 times to prevent a red eye phenomenon, the operation of the loop of the above-mentioned Steps #7 to #15 will be repeated 17 times and this number of times will be checked in Step #16. When the pre-flash by 17 small flashes ends, then in Step #17, the main flash is made or the timing is checked by a CPU or the like.

Then, when the timing for making the main flash is made, in Step #18, the charge starting signal CHG becomes "H"again and, after the time of the timer 1 of Step #19 elapses, in Step #20, the above-mentioned signal CHG is made "L" and, in Step #21, the flash starting signal STON is made "H" and the main flash is started. Then, after the time of the timer 2 of Step #22 elapses, in Step #23, the above-mentioned starting signal STON is made "L" and then, in Step #24, the integration of a photographing light amount ends, that is to say, whether the exposure is proper or not is checked and if it is yes, in Step #25, the flash stopping signal STOFF is made "H" and then, after the time of the timer 3 in Step #25-1 elapses, in Step #26, the signal STOFF is made "L" and the strobo flashing photographing accompanying the pre-flashing operation ends.

Thus, also in the above-mentioned strobo controlling circuit of the sixth embodiment, just before each flash, the power source voltage boosting circuit 62 is started and the sub-condenser 74 is charged. Therefore, the sub-condenser 74 may only hold the gate biasing voltage for 0 to several ms and therefore may be a condenser of a very small capacity and there are obtained effects that the actually fitting space is small and the cost is low. It is not necessary to provide an intermediate tap on the secondary side of the main transformer as in the past.

Figure 13:
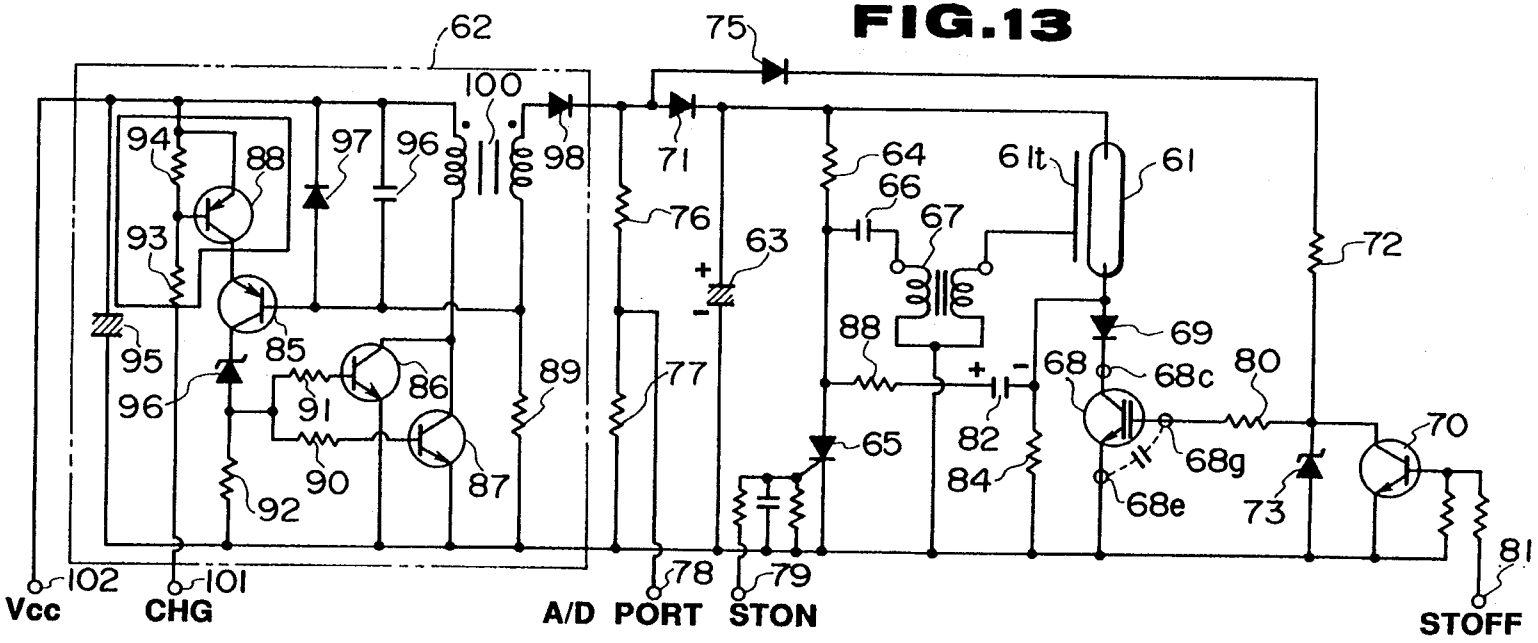
FIG. 13 is an electric circuit diagram of a controlling circuit of a strobo apparatus showing a seventh embodiment of the present invention.

FIG. 13 shows an electric circuit of a strobo apparatus of the seventh embodiment of the present invention. In this seventh embodiment, the sub-condenser 74 in the electric circuit of the sixth embodiment in FIG. 10 is removed and a sub-condenser feeding a voltage for maintaining the IGBT 68 on is formed of a gate capacity of the IGBT itself. That is to say, as the IGBT has itself a gate capacity of 1000 to 3000 PF, if this is utilized, the gate bias will be able to be well applied. Therefore, the electric circuit of the seventh embodiment is formed exactly the same as in the sixth embodiment except that the sub-condenser 74 is removed from the electric circuit of the above-mentioned sixth embodiment.

In the thus formed seventh embodiment, the power source voltage boosting circuit 62 is started by a charge starting signal CHG from the CPU and the main condenser 63 is charged. When the main condenser 63 reaches a set voltage, the CPU will once interrupt the application of the charge starting signal. Just before a flash starting signal STON is input, for several ms to several 100 ms, a charge starting signal CHG is applied to drive the power source voltage boosting circuit 62. Then, a charge is stored again in the gate capacity of the IGTB 68 itself and a gate bias is applied to switch on the IGBT 68. Then, a flash starting signal STON is applied to make a strobo flashing photographing. Meanwhile, in the IGTB 68, a gate bias is well held by the charge stored in the gate capacity of 1000 to 3000 PF. Thereafter, a flash stopping signal STOFF is input from the CPU, the transistor 70 is switched on, the gate of the IBGT is shunted and the flash is stopped. The flow chart of this seventh embodiment may be also the same as in the above-described FIG. 13.

In the case of making a pre-flash to prevent a red eye, the same as in the case of the above-mentioned sixth embodiment, just before each pre-flash, the charge starting signal CHG is applied, the power source voltage boosting circuit 62 is started, the gate capacity of the IGBT 68 is charged with a charge and a gate bias is applied. The subsequent operation is the same as the red eye preventing operation using the above-mentioned sixth embodiment.

According to this seventh embodiment, as the sub-condenser of the gate biasing power source is unnecessary, the cost and actually fitting space can be further reduced.

Figure 14:
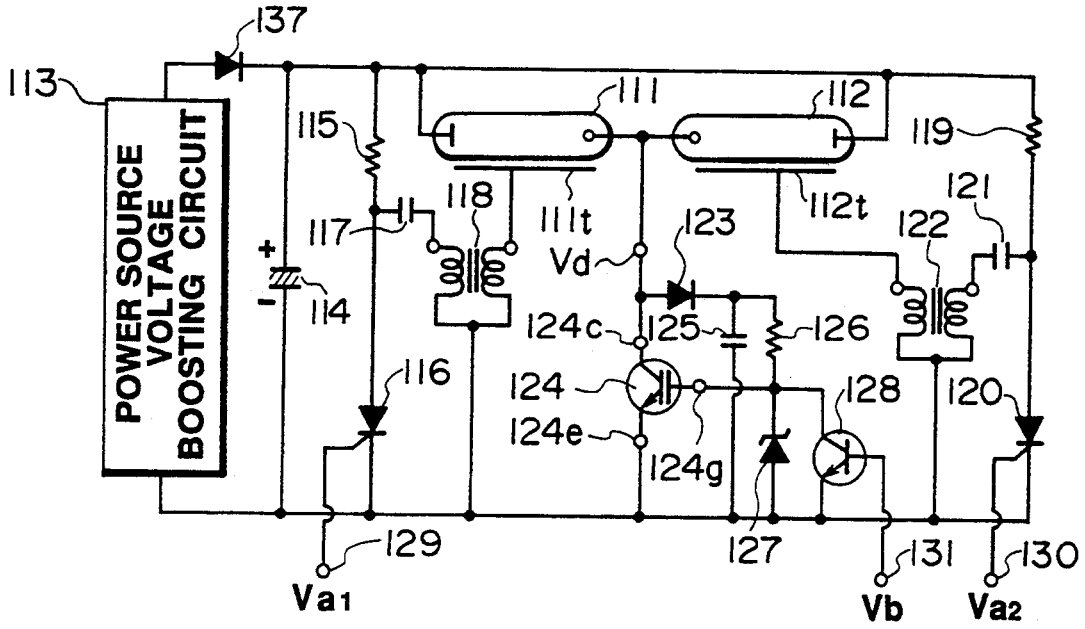
FIG. 14 is an electric circuit diagram of a controlling circuit of a strobo apparatus showing the eighth embodiment of the present invention.

Now, FIG. 14 shows the eighth embodiment of the present invention. The strobo flash controlling circuit of this eighth embodiment is formed to control the flashing operation and flash stopping operation of a plurality of discharge tubes, that is, two discharge tubes of a first flashing discharge tube 111 and second flashing discharge tube 112.

In this flash controlling circuit, to both ends of a power source voltage boosting circuit 113 including a power source for feeding a high voltage required to discharge the first flashing discharge tube 111 and second flashing discharge tube 112 are connected respectively a main condenser 114 storing the charge fed from the power source voltage boosting circuit 113 and necessary for the flash , a series circuit of a resistance 115 and flash start triggering first thyristor 116, a series circuit comprising a gate-controlling type first switching device 124 connected in series with the above-mentioned first and second flashing discharge tubes 111 and 112 respectively connected in parallel and a series circuit of a resistance 119 and flash start triggering second tyristor 120 through a reverse flow preventing diode 137 of the above-mentioned main condenser.

When a flash starting voltage Val is applied to the gate from an input terminal 129, the above-mentioned mentioned triggering first thyristor 116 will be switched on to operate the first trigger circuit. This first trigger circuit comprises a first trigger condenser 117 connected at one end to the connecting point of the above-mentioned resistance 115 and thyristor 116 and at the other end to the primary winding of the triggering transformer 118, a first triggering transformer 118 having the secondary winding connected to a trigger electrode 111t of the above-mentioned first discharge tube 111 and generating an exciting high voltage pulse to be applied to the electrode 111t and the above-mentioned first thyristor 116 which, when switched on, will discharge through the primary winding of the above-mentioned trigger transformer 118 the charge accumulated in the above condenser 117.

When a flash starting voltage Va2 is applied to the gate from an input terminal 130, the above-mentioned triggering second thyristor 120 will be also switched on in the same manner to operate the second trigger circuit. This second trigger circuit comprises a second trigger condenser 121 connected at one end to the connecting point of the above-mentioned resistance 119 and thyristor 120 and at the other end to the primary winding of a trigger second transformer 122, the second trigger transformer 122 having the secondary winding connected to a trigger electrode 112*t* of the above-mentioned secondary discharge tube 112 and generating an exciting high voltage pulse to be applied to the electrode 112 and the above-mentioned second thyristor 120 which, when switched on, will discharge through the primary winding of the above mentioned trigger transformer 122 the charge accumulated in the above-mentioned condenser 121.

The above-mentioned gate-controlling type first switching device 124 is a gate-controlling type switching device which will be conductive between the collector 124*c* and emitter 124*e* when a biasing voltage is applied to the gate electrode 124*g* but will be non-conductive when the voltage application to the gate electrode 124*g* is interrupted. A Zener diode 127 for obtaining a voltage sufficient for the conduction to the gate electrode 124*g* and not broken by the gate electrode 124*g* is connected between the gate electrode 124*g* and emitter 124*e* of the switching device.

Also, a condenser 125 for storing a gate biasing charge is connected through a diode 123 between the collector 124*c* and emitter 124*e* of the above-mentioned first switching device 124 so that the charge stored in the condenser 125 may apply a biasing voltage to the gate electrode 124*g* through the resistance 126. The above-mentioned diode 123 charges the condenser 125 with the discharge current of the above-mentioned flashing discharge tube 111 or 112 to act to prevent the charge of the condenser 125 from being discharged through the device 124 even after the conduction of the switching device 124.

A second switching device 128 comprising a transistor shunting the gate of the first switching device 124 is connected in parallel with the above-mentioned Zener diode 127. This second switching device 128 will be switched on when a flash stopping voltage Vb is applied to the base from an input terminal 131 when the flash is stopped to act to hold the gate electrode 124*g* of the first switching device 124 below the voltage at which the switching device 124 becomes non-conductive.

Figure 15:
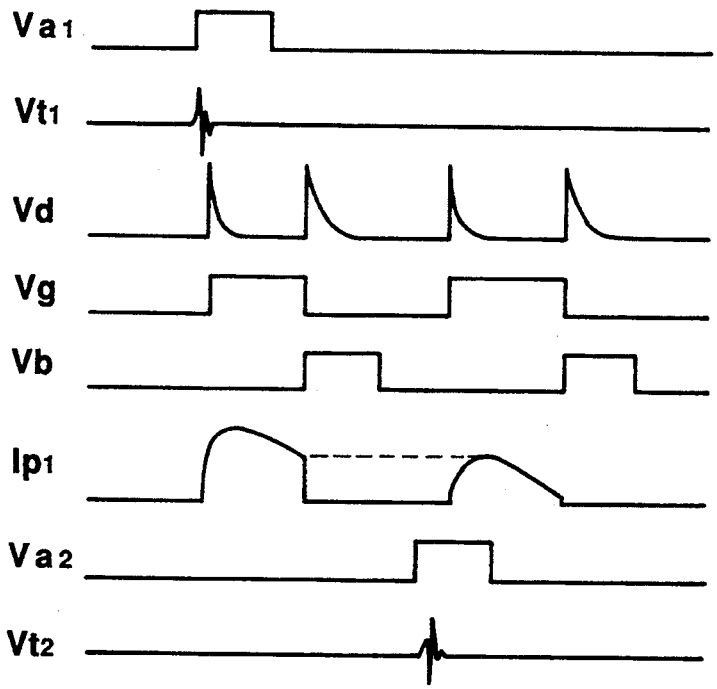
FIG. 15 is a time chart of the operation of the controlling circuit of the above-mentioned eighth embodiment.
Figure 16:
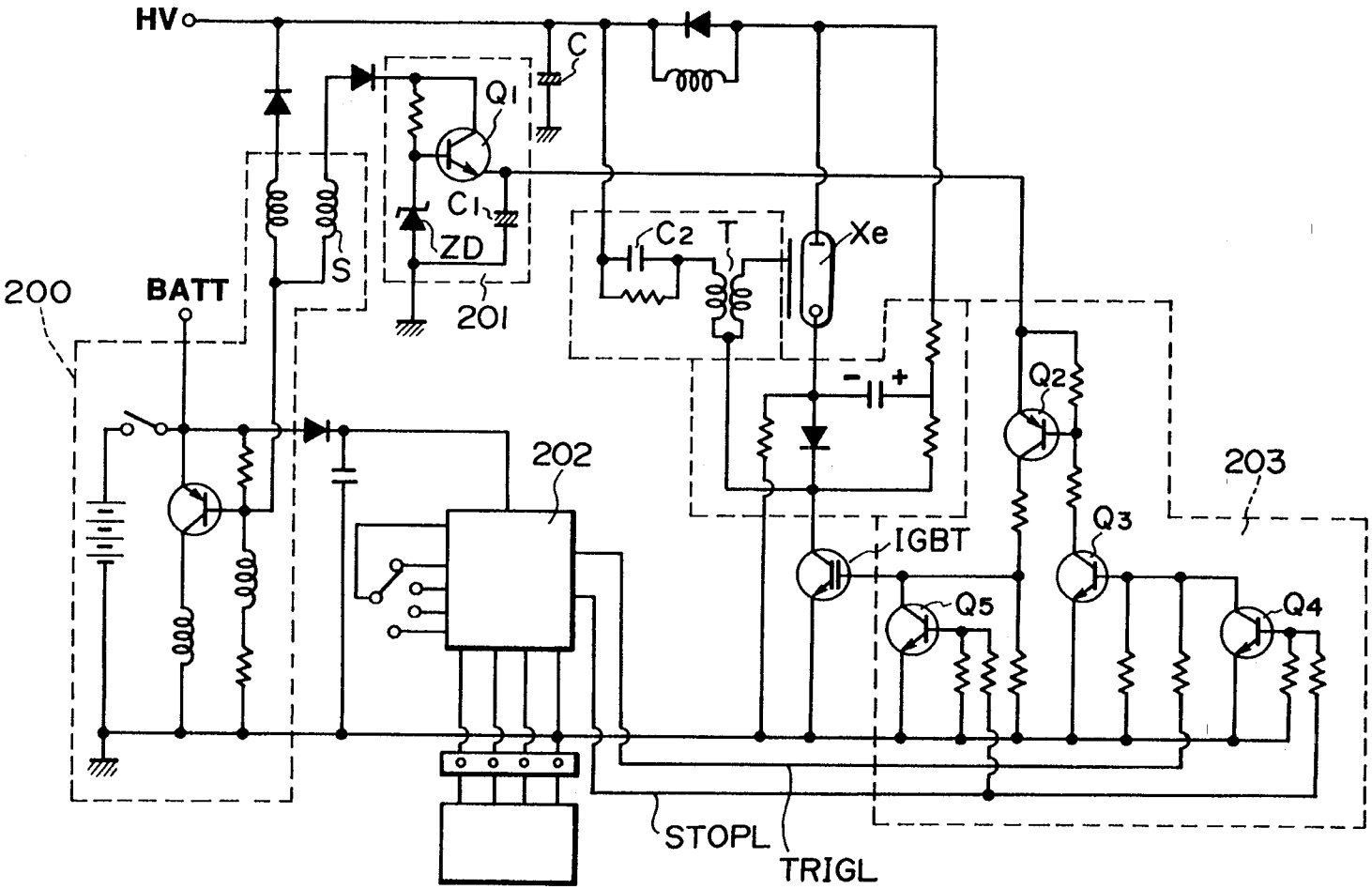
FIG. 16 (PRIOR ART)
FIG. 16 is an electric circuit diagram showing an example of controlling circuit of a conventional strobo apparatus.

The operation of the thus formed flash controlling circuit of the above-mentioned eighth embodiment shall be explained in the following together with the time chart in FIG. 15.

When a power source switch (not illustrated) is switched on, the main condenser 114 will be charged with a charge sufficient for the discharge tubes 111 and 112 to flash by the output of the voltage boosting circuit 113. In this state, the trigger condensers 117 and 121 will be also charged with the same voltage respectively through the resistances 115 and 119.

In case, first of all, the flashing discharge tube 111 is made to flash and, just after it, the flashing discharge tube 112 is made to flash, first a flash starting voltage Val will be applied to the input terminal 129. That is to say, a voltage necessary to turn on the first thyristor 116 will be applied to the gate of the thyristor by the flash starting voltage Val to the circuit system for making the discharge tube 111 flash. Then the thyristor 116 will be on, the charge of the condenser 117 will flow through the primary winding of the trigger transformer 118, a high pulse voltage will be generated in the secondary winding and this exciting high voltage pulse Vt1 will be applied to the trigger electrode 111*t* of the discharge tube 111. The discharge tube 111 will be excited by this high voltage pulse $V_{t1}$ to be conductive. At this time, the first switching device 124 will not yet be conductive, the current discharged through the discharging tube 111 from the main condenser 114 will charge the condenser 125 through the diode 123, when the terminal voltage rises, the voltage generated by the Zener diode 127 through the resistance 126 will be given to the gate electrode 124*g* of the first switching device 124, the first switching device 124 will be conductive, the current $I_{p1}$ flowing through the discharge tube 111 will flow from the collector 124*c* to the emitter 124*e* and the discharge flash will continue.

When the first switching device 124 is switched on, the voltage Vd of the collector 124*c* which rose when the first light emitting discharge tube 111 became conductive will reduce to be below several volts but the charge stored by the condenser 125 will be prevented by the diode 123 from being discharged through the first switching device 124.

After the light is emitted for any time, as soon as a light emission stopping voltage Vb stopping the light emission is applied to the input terminal 131, the second switching device 128 will be on, the voltage of the gate electrode 124 of the first switching device 124 will reduce, the switching device 124 will become non-conductive, the course of the current flowing through the first discharge tube 111 will be interrupted and the light emission of the first light emitting discharge tube 111 will stop. After the first discharge tube 111 is extinguished, the flash stopping signal to the second switching device 128 will be released.

Then, after the flash of the above-mentioned first discharge tube 111 is stopped, subsequently the second flashing discharge tube 112 will be made to flash.

In this flashing operation, the same as in the case of the above-mentioned first discharge tube 111, a flash starting voltage $V_{a2}$ is applied to the input terminal 130. That is to say, by the flash starting voltage $V_{a2}$ to the circuit system for making the discharge tube 112 flash, a voltage required to turn on the second thyristor 120 is applied to the gate. Then the above-mentioned second thyristor 120 will be on, the charge of the triggering condenser 121 will flow through the primary winding of the second trigger transformer 122, thereby a high pulse voltage will be generated in the secondary winding and this trigger pulse $V_{t2}$ will be applied to the trigger electrode 112*t* of the second discharge tube 112. The second discharge tube 112 will be excited by the above-mentioned pulse voltage $V_{t2}$ to be conductive. At this time, the first switching device 124 will be made non-conductive by the flash stopping voltage Vb which is a prior flash stopping signal but the application of the flash stopping voltage Vb will have been already released, therefore the same circuit operation as in the previous explanation of the flashing operation of the above-mentioned first flashing discharge tube 111 will be made, finally the first switching device 124 will be conductive and the second discharge tube 112 will continue the discharge flash.

After the flashing, in case the flash is to be stopped, the flash stopping voltage Vb which is a flash stopping signal is applied to the input terminal 131. Then, the second switching device 128 will be on, the voltage of the gate electrode 124*g* of the first switching device 124 will reduce, the switching device 124 will become non-conductive,the course of the current flowing through the second discharge tube 112 will be interrupted and the flash of the second discharge tube will stop. The application of the flash stopping voltage Vb which is a flash stopping signal to the second switching device 128 will be released after the flash of the second discharge tube 112 is stopped.

Thus, the circuit operation until the flash is stopped after the second discharge tube 112 becomes conductive is exactly the same as in the case of the above-mentioned first discharge tube 111.

In the explanation of the above-mentioned eighth embodiment, after the first discharge tube 111 is made to flash, the second discharge tube 112 is made to flash but this order is not specifically restricted, after the second discharge tube 112 flashes, the first discharge tube 111 may be made to flash, It is needless to say that the flash may be repeated any number of times until the residual voltage of the main condenser 114 after the flash is stopped falls below the lowest voltage required for the discharge tube to flash.

By the way, in the controlling circuits of the respective embodiments explained above, to simplify the explanation, the current limiting resistance, the shunt resistance between the cathode and gate of the thyristor and the shunt resistance between the emitter and base of the condenser of transistor are omitted.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein described.

What is claimed is:

1. A strobo apparatus comprising:

a power source voltage boosting circuit;

a main condenser to be charged with a boosted voltage by said power source voltage boosting circuit;

a series circuit connected in parallel with said main condenser and comprising a flash discharge tube and a gate-controlling type first switching device having a gate electrode;

a trigger circuit for exciting said flash discharge tube to be conductive in response to a flash starting signal;

a bias condenser connected to said first switching device and charged with a discharge current flowing through said flash discharge tube;

a voltage dividing circuit connected in parallel with said bias condenser and dividing and applying the charge voltage of said bias condenser to the gate electrode of said gate-controlling type first switching device; and a second switching device connected to said gate electrode, receiving a flash stopping signal and preventing the application of the voltage by said voltage dividing circuit to said gate electrode.

2. A strobo apparatus according to claim 1 wherein said first switching device consists of a gate-insulating type bipolar transistor (IGBT).

3. A strobo apparatus according to claim 1 wherein said IGBT has an emitter electrode and said voltage dividing circuit consists of a series circuit of a resistance and Zener diode and the gate electrode and emitter electrode of said first switching device are connected across said Zener diode.

4. A strobo apparatus according to claim 3 characterized in that a speed up condenser is further connected in parallel with said resistance.

5. A strobo apparatus according to claim 1 wherein a reverse flow preventing diode is provided between the connecting point of said flash discharge tube and first switching device and one end of said biasing condenser.

6. A strobo apparatus according to claim 1 characterized in that, Said second switch device includes a controlling electrode so that when said flash discharge tube is active, the controlling electrode of said second switching device will repeatedly receive said flash stopping signal and continuously flash.

7. A strobo apparatus comprising:

a power source voltage boosting circuit;

a main condenser to be charged with a boosted voltage by said power source voltage boosting circuit;

at least one flash discharge tube connected in a discharge loop of said main condenser;

a single gate-controlling type first switching device connected in a discharge loop flowing through said flash discharge tube and having a gate electrode;

a self-biasing circuit self-biasing the gate electrode of said first switching device and using as a power source the charge of a biasing condenser charged by the discharge current flowing through said flash discharge tube in response to a flash starting signal; and a second switching device connected to said gate electrode, for receiving a flash stopping signal and preventing the application of the voltage by said self-biasing circuit to said gate electrode.

8. A strobo apparatus according to claim 7 wherein said first switching device consists of a gate-insulating type bipolar transistor (IGBT).

9. A strobo apparatus according to claim 7 characterized in that, said second switch device includes a controlling electrode so that when said flash discharge tube is active, the controlling electrode of said second switching device will repeatedly receive said light emission stopping signal and said flash discharge tube will continuously flash.

10. A strobo apparatus according to claim 7 characterized in that, said second switch device includes a controlling electrode so that until said flash discharge tube becomes inactive, said flash discharge tube will flash and the controlling electrode of said second switching device will repeatedly receive said flash stopping signal to cause the flash discharge tube to flash intermittently.

11. A strobo apparatus comprising a voltage boosting circuit including a power source, a main condenser charged by said voltage boosting circuit, a flash discharge tube, a gate-controlling type first switching device having a gate electrode and being connected in series in the discharge course of said main condenser including said flash discharge tube, a trigger means applying a starting voltage to a trigger electrode of said flash discharge tube in response to a flash starting signal to excite said flash discharge tube to be conductive and a gate electrode controlling means of said first switching device;

characterized in that said gate electrode controlling means comprises:

a voltage applying means applying a voltage to the gate electrode of said first switching device responsive to a discharge current of said flash discharge tube said discharge current being present when the flash discharge tube is excited to be conductive, said voltage converting said first switching device to be conductive; and a voltage application stopping means stopping the application of a voltage to the gate electrode of said first switching device in response to a flash stopping signal.

12. A strobo apparatus according to claim 11 wherein said voltage applying means comprises a biasing condenser charged with the discharge current of said flash discharge tube and a resistance applying the voltage of said condenser to said gate electrode and said voltage application stopping means comprises a second switching device stopping the application of a voltage to the gate electrode of said first switching device responsive to a flash stopping signal.

13. A strobo apparatus according to claim 11 wherein said voltage applying means comprises a biasing condenser charged with the discharge current of said flash discharge tube, a resistance applying the voltage of said condenser to said gate electrode and a speed up condenser connected in parallel with said resistance and said voltage application stopping means comprises a second switching device stopping the application of a voltage to the gate electrode of said first switching device responsive to a flash stopping signal.

14. A strobo apparatus comprising:

a power source voltage boosting circuit;

a main condenser to be charged with a boosted voltage by said power source voltage boosting circuit;

a series circuit connected in parallel with said main condenser and comprising a flash discharge tube and a gate-controlling type first switching device having a gate electrode;

a trigger circuit exciting said flash discharge tube to be conductive in response to a flash starting signal;

a bias circuit coupled to said main condenser and applying to the gate electrode of said first switching device a voltage derived by dividing a charge voltage of a bias power source condenser charged with the boosted voltage of said power source voltage boosting circuit to turn on the first switching device; and a second switching device connected to said gate electrode, receiving a flash stopping signal and preventing the application of the voltage by said bias circuit to said gate electrode.

15. A strobo apparatus according to claim 14 wherein said first switching device comprises a gate-insulating type bipolar transistor (IGBT).

16. A strobo apparatus comprising:

a power source voltage boosting circuit;

a main condenser to be charged with a boosted voltage by said power source voltage boosting circuit;

a series circuit connected in parallel with said main condenser and comprising a flash discharge tube and a gate-controlling type first switching device having a gate electrode;

a trigger circuit exciting said flash discharge tube to be conductive in response to a flash starting signal;

a bias circuit coupled to said main condenser and applying to the gate electrode of said first switching device a voltage derived by dividing a charge voltage of a bias power source condenser charged with the boosted voltage of said power source voltage boosting circuit to turn on the first switching device; and a second switching device connected to said gate electrode, receiving a flash stopping signal and preventing the application of the voltage by said bias circuit to said gate electrode;

said bias circuit including a series circuit of a resistance and Zener diode and the connecting point of said resistance and Zener diode and the gate electrode of said first switching device are connected with each other.

17. A strobo apparatus according to claim 16 characterized in that said series circuit is connected directly with said main condenser and a voltage is applied thereto by said main condenser.

18. A strobo apparatus according to claim 16 wherein said bias power source condenser is connected to said main condenser through a first diode for preventing a reverse flow therethrough, said series circuit being connected in parallel with said bias power source condenser and said series circuit being fed power from said bias power source condenser.

19. A strobo apparatus according to claim 18 characterized in that a reverse flow preventing second diode is connected between said first switching device and said gate power source condenser.

20. A strobo apparatus comprising:

a power source voltage boosting circuit;

a main condenser to be charged with a boosted voltage by said power source voltage boosting circuit;

a series circuit connected in parallel with said main condenser and comprising a flash discharge tube and a gate-controlling type first switching device having a gate electrode;

a trigger circuit exciting said flash discharge tube to be conductive in response to a flash starting signal;

a bias circuit coupled to said main condenser and applying to the gate electrode of said first switching device a voltage derived by dividing the charge voltage of a bias power source condenser charged with the boosted voltage of said power source voltage boosting circuit to turn on the first switching device; and a second switching device connected to said gate electrode, receiving a flash stopping signal and preventing the application of the voltage by said bias circuit to said gate electrode;

said bias circuit including a series circuit of a resistance and Zener diode and the connecting point of said resistance and Zener diode and the gate electrode of said first switching device being connected with each other;

said first switching device having an emitter electrode, the gate electrode of said first switching device and emitter electrode being connected across said Zener diode.

21. A strobo apparatus according to claim 7 characterized in that, said second switch device includes a controlling electrode so that until said flash discharge tube becomes inactive, said flash discharge tube will flash and the controlling electrode of said second switching device will repeatedly receive said flash stopping signal to cause the flash discharge tube to flash intermittently to prevent a red eye condition.

22. A strobo apparatus comprising:

a voltage boosting circuit including a power source;

a main condenser charged by said voltage boosting circuit;

a flash discharge tube forming part of a discharge loop coupled to said main condenser;

a gate-controlling type first switching device connected in series in the discharge loop of said main condenser and having a gate electrode;

a trigger means for exciting said flash discharge tube to be conductive responsive to a flash starting signal;

a gate-controlling means coupled between the main capacitor and the gate electrode for applying a voltage to the gate electrode of said gate-controlling type first switching device to enable the first switching device to conduct during the charging of the main condenser and before and independent of the exciting operation by said trigger means is started by a flash starting signal, and means for stopping the application of the voltage to the gate electrode of said first switching device in response to a flash stopping signal and making the first switching device non-conductive.

23. A strobo apparatus comprising:

a voltage boosting circuit including a power source;

a main condenser charged by said voltage boosting circuit;

a flash discharge tube forming part of a discharge loop coupled to said main condenser;

a gate-controlling type first switching device connected in series in the discharge loop of said main condenser and having a gate electrode;

a trigger means for exciting said flash discharge tube;

a gate-controlling means applying a voltage to the gate electrode of said gate-controlling type first switching device before the exciting operation by said trigger means is started, and means for stopping the application of the voltage to the gate electrode of said first switching device in response to a flash stopping signal and making the first switching device non-conductive;

said gate-controlling means dividing the charge voltage of said main condenser and applies the divided voltage to said electrode.

24. A strobo apparatus comprising:

a voltage boosting circuit including a power source;

a main condenser charged by said voltage boosting circuit;

a flash discharge tube forming part of a discharge loop coupled to said main condenser;

a gate-controlling type first switching device connected in series in the discharge loop of said main condenser and having a gate electrode;

a trigger means for exciting said flash discharge tube to be conductive responsive to a flash starting signal;

a gate-controlling means applying a voltage to the gate electrode of said gate-controlling type first switching device to enable the first switching device to conduct during the charging of the main condenser and before the exciting operation by said trigger means is started by a flash starting signal, and means for stopping the application of the voltage to the gate electrode of said first switching device in response to a flash stopping signal and making the first switching device non-conductive; and said gate-controlling means charging a gate biasing condenser with the boosted voltage of said voltage boosting circuit, divides said charge voltage and applies the divided voltage to said gate electrode as a bias voltage.

25. A strobo apparatus comprising a voltage boosting circuit including a power source, a main condenser charged by said voltage boosting circuit, a flash discharge tube, a gate-controlling type first switching device connected in series in the discharge course of said main condenser including said flash discharge tube, a trigger means applying a starting voltage to a trigger electrode of said flash discharge tube in response to a flash starting signal to excite said flash discharge tube to be conductive and a gate electrode controlling means of said first switching device;

characterized in that said gate electrode controlling means comprises:

a voltage applying means applying a predetermined voltage obtained from the charge voltage of said main condenser to the gate electrode of said first switching device to maintain said first switching device conductive and a voltage application stopping means stopping the voltage application to the gate electrode of said first switching device in response to a flash stopping signal.

26. A strobo apparatus according to claim 25 wherein said voltage applying means comprises a resistance for applying the charge voltage of said main condenser to said gate electrode; and said voltage application stopping means comprises a second switching device stopping the voltage application to the gate electrode of said first switching device.

27. A strobo apparatus comprising a voltage boosting circuit including a power source, a main condenser charged by said voltage boosting circuit, a flash discharge tube, a gate-controlling type first switching device having a gate electrode and being connected in series in the discharge course of said main condenser including said flashing discharge tube, a trigger means applying a starting voltage to a trigger electrode of said flash discharge tube in response to a flash starting signal to excite said flash discharge tube to be conductive, and a gate voltage controlling means for said first switching device;

characterized in that said gate voltage controlling means comprises:

a voltage applying means connected to said voltage boosting circuit and applying a predetermined voltage obtained from said voltage boosting circuit to the gate electrode of said first switching device to maintain said first switching device conductive responsive to a charging signal which occurs prior to and independent of said flash starting signal; and a voltage application stopping means stopping the voltage application to the gate electrode of said first switching device in response to a flash stopping signal.

28. A strobo apparatus according to claim 27 wherein:

said voltage applying means comprises a biasing condenser charged by said voltage boosting circuit and a resistance applying the voltage of said biasing condenser to said gate electrode; and said voltage application stopping means comprising a second switching device stopping the voltage application to the gate electrode of said first switching device.

29. A strobo flash controlling apparatus comprising:

a voltage boosting circuit including a power source and means for boosting the power source voltage in response to an operating signal;

a main condenser and a bias condenser charged by said voltage boosting circuit;

a flash discharge tube having a trigger electrode;

a gate-controlling type first switching device connected in series in a discharge course of said main condenser including said flash discharge tube;

said first switching device having a gate electrode;

trigger means applying a starting voltage to the trigger electrode of said flash discharge tube in response to a flash starting signal to excite said flash discharge tube to be conductive;

a voltage applying means including said bias condenser connected to said voltage boosting circuit and applying a predetermined voltage obtained from said voltage boosting circuit to the gate electrode of said first switching device independent of and prior to said flash starting signal to maintain said first switching device conductive;

a voltage application stopping means stopping the voltage application to the gate electrode of said first switching device responsive to a flash stopping signal; and an operation controlling means connected to said voltage boosting circuit, trigger means and voltage application stopping means and sequentially outputting said operating signal, flash starting signal and flash stopping signal respectively at predetermined time intervals for intermittently operating said voltage boost circuit and said flash discharge tube.

30. A strobo flash controlling apparatus according to claim 29 characterized in that said operation controlling means outputs an operating signal to said voltage boosting circuit to operate the voltage boosting circuit just before a flash starting signal is output to said trigger means.

31. A strobo flash controlling apparatus according to claim 30 wherein:

said voltage applying means comprises a biasing condenser charged by said voltage boosting circuit and a resistance applying the voltage of said biasing condenser to said gate electrode; and said voltage application stopping means comprises a second switching device stopping the voltage application to the gate electrode of said first switching device.

32. A strobo apparatus according to claim 1 wherein the capacity of the bias condenser is very small due to the fact that the bias condenser applies a voltage to said gate electrode only during discharge of the flash discharge tube.

33. A strobo apparatus according to claim 1 wherein said bias condenser comprises the gate capacity of said first switching device.

34. A strobo apparatus according to claim 33 wherein the gate capacity of said first switching device is in the range from 1,000 to 3,000 picofarads.

35. A strobo apparatus according to claim 1 wherein said first switching device Includes an emitter electrode; and the break-down voltage of the first switching device gate electrode is greater than the charging voltage of said main condenser to eliminate the need for clamping means to clamp the voltage between the gate electrode and the emitter electrode.

36. A strobo apparatus comprising a voltage boosting circuit including a power source, a main condenser charged by said voltage boosting circuit, a flash discharge tube, a gate-controlling type first switching device having a gate electrode and being connected in series in the discharge circuit of said main condenser including said flash discharge tube, a trigger means applying a starting voltage to a trigger electrode of said flash discharge tube in response to a flash starting signal to excite said discharge tube to be conductive and a gate electrode controlling means for controlling said first switching device;

characterized in that said gate electrode controlling means comprises:

a voltage applying means coupled to said main condenser for applying a divided voltage to the gate electrode of said first switching device to render said first switching device conductive prior to and independent of said flash starting signal; and a voltage application stopping means stopping the application of a voltage to the gate electrode of said first switching device responsive to a flash stopping signal.

37. A strobo apparatus according to claim 36 wherein said first switching device includes an emitter electrode; and means coupled between said gate and emitter electrodes for clamping the voltage therebetween.

38. A strobo apparatus according to claim 1 further comprising a voltage doubling condenser connected between said trigger circuit and the common connection between said flash discharge tube and said first switching device and cooperating with said main condenser to apply a voltage substantially double the charging voltage of the main condenser responsive to said trigger circuit being rendered conductive.

39. A strobo apparatus comprising:

a voltage boosting circuit including a power source;

a main condenser charged by said voltage boosting circuit;

a flash discharge tube forming part of a discharge loop coupled to said main condenser;

a gate-controlling type first switching device connected in series in the discharge loop of said main condenser and having a gate electrode;

a trigger means for exciting said flash discharge tube to be conductive;

a gate-controlling means applying a voltage to the gate electrode of said gate-controlling type first switching device before the exciting operation by said trigger means is started, and means for stopping the application of the voltage to the gate electrode of said first switching device in response to a flash stopping signal and making the first switching device non-conductive;

said gate-controlling means comprising a second condenser charged by said voltage boosting circuit through a diode and a series circuit comprised of a resistance element and a Zener diode connected in parallel with the second condenser, and the gate electrode of said first switching device is connected to a junction of said resistance and the Zener diode.

40. A strobo apparatus comprising:

a voltage boosting circuit including a power source;

a main condenser charged by said voltage boosting circuit;

a flash discharge tube forming part of a discharge loop coupled to said main condenser;

a gate-controlling type first switching device connected in series in the discharge loop of said main condenser and having a gate electrode;

a trigger means for exciting said flash discharge tube to be conductive;

a gate-controlling means applying a voltage to the gate electrode of said gate-controlling type first switching device before the exciting operation by said trigger means is started, and means for stopping the application of the voltage to the gate electrode of said first switching device in response to a flash stopping signal and making the first switching device non-conductive;

said gate-controlling means including a series circuit comprising a diode, a resistance element and a Zener diode connected in parallel with said voltage boosting circuit; the gate electrode of said first switching device being connected to a junction of said resistance element and the Zener diode for charging the gate capacity of said first switching device by a voltage boosting operation of said voltage boosting circuit.

41. A strobo apparatus comprising:

a power source voltage boosting circuit;

a main condenser being charged by a boosted voltage from said power source voltage boosting circuit;

first and second series circuits connected in parallel with said main condenser and respectively comprising first and second flash discharge tubes connected in parallel, the first end of said parallel connection being coupled to said main condenser, the opposite end of said parallel connection being coupled to a gate-controlling-type first switching device having a gate electrode;

first and second trigger circuits for respectively exciting said first and second flash discharge tubes to be conductive in response to respective first and second flash starting signals;

a bias condenser connected to said first switching device and being charged with a discharge current flowing through at least one of said flash discharge tubes;

a voltage dividing circuit connected in parallel with said bias condenser and dividing and applying the charge voltage of said bias condenser to the gate electrode of said gate-controlling-type first switching device; and a second switching device connected to said gate electrode, receiving a flash stopping signal and preventing the application of the voltage by said voltage dividing circuit to said gate electrode.

42. A strobo apparatus comprising:

a power source voltage boosting circuit;

a main condenser to be charged with a boosted voltage by said power source voltage boosting circuit;

a series circuit connected in parallel with said main condenser and comprising a flash discharge tube and a gate-controlling type first switching device having a gate electrode;

a trigger circuit exciting said flash discharge tube to be conductive in response to a flash starting signal;

a bias circuit directly coupled to said main condenser and applying to the gate electrode of said first switching device a voltage derived by dividing a charge voltage of said main condenser to turn on the first switching device independent of conduction of the flash; and a second switching device connected to said gate electrode, receiving a flash stopping signal and preventing the application of the voltage by said bias circuit to said gate electrode.

43. A strobo apparatus according to claim 42 wherein said bias circuit includes a series circuit of a resistance and Zener diode and the connecting point of said resistance and Zener diode and the gate electrode of said first switching device are connected with each other.

44. A strobo apparatus comprising:

a power source voltage boosting circuit;

a main condenser to be charged with a boosted voltage by said power source voltage boosting circuit;

a series circuit connected in parallel with said main condenser and comprising a flash discharge tube and a gate-controlling type first switching device having a gate electrode;

a trigger circuit exciting said flash discharge tube to be conductive in response to a flash starting signal;

a bias circuit coupled to said main condenser and applying to the gate electrode of said first switching device a voltage made by dividing the charge voltage of said main condenser to turn on the first switching device;

a second switching device connected to said gate electrode, receiving a flash stopping signal and preventing the application of the voltage by said bias circuit to said gate electrode;

said bias circuit including a series circuit of a resistance and Zener diode and the connecting point of said resistance and Zener diode and the gate electrode of said first switching device being connected with each other; and said first switching device having an emitter electrode, the gate electrode of said first switching device and emitter electrode being connected across said Zener diode.

45. The strobo apparatus of claim 29 wherein said operation controlling means further includes means for repeatedly generating said operating signal, flash signal and flash stopping signal for a predetermined number of cycles, each cycle including operating, flash and flash stopping signals.

46. A method for operating a strobo apparatus comprising a power source voltage boosting circuit, a main condenser and a bias condenser coupled to said power source voltage boosting circuit, and a series circuit comprised of a flash tube coupled to said main condenser and having an exciting electrode and a switching device coupled to said flash tube and a trigger circuit for exciting the flash tube, said method comprising the steps of:

energizing said power source voltage boosting circuit to charge said main condenser and bias condenser, said switching device being rendered conductive by the charged bias condenser;

activating said trigger circuit responsive to a trigger signal which is initiated totally independently of initiation of conduction of the switching device for exciting said flash tube which conducts through said first switching device; and activating said stopping circuit which renders the switching device non-conductive to terminate discharge of said flash tube responsive to a stopping signal.

47. A method for operating a strobo apparatus comprised of a power source voltage boosting circuit and main and bias condensers coupled thereto, a flash tube coupled in electrical series with a first switching circuit, said main condenser being coupled to discharge through said flash tube, a controlling circuit coupled to said bias condenser for controlling a gate electrode of said first switching circuit, and a stopping circuit for turning off said switching circuit, said method comprising the steps of:

(a) activating said power source voltage boosting circuit for a first interval responsive to a charging signal whereby said main and bias condensers are charged and said controlling circuit renders said first switching circuit conductive responsive to the charging of said bias condenser;

(b) thereafter applying a supplemental charging signal to operate said power source voltage boosting circuit for a second time interval responsive to a trigger signal to further charge said main and bias condensers;

(c) applying a flash exciting signal of a short predetermined time interval to said trigger circuit sufficient to excite said flash tube;

(d) applying a stop pulse to said stopping circuit a short predetermined time interval after initiation of said flash exciting signal to render said first switching non-conductive to turn off the flash tube and whereby said flash tube generates a pulse of light; and (e) repeating steps (b) through (d) to generate a predetermined number of flash pulses in order to prevent red-eye phenomenon;

(f) counting the number of times steps (b) through (d) are performed;

(g) applying a charge pulse of a predetermined time interval to said power source voltage boosting circuit to recharge said main and bias condensers responsive to said predetermined count; and (h) applying a pulse of a predetermined time interval to said trigger circuit to excite said flash tube to initiate a flash discharge for a photographing operation.

48. The method of claim 46 wherein a bias condenser of a reduced capacity and size is provided, and the bias condenser is intermittently charged before each flash enabling the bias condenser, which is of reduced capacity, to retain its charge for a sufficient period of time to assure a desired flash operation and further reducing a space required for said bias condenser.

49. A strobo apparatus comprising:

a power source voltage boosting circuit;

a main condenser charged by a boosted voltage from said power source voltage boosting circuit;

a flash discharge tube forming a part of a discharge path connected to said main condenser;

a first switching device connected in series in the discharge path of said main condenser, said first switching device having a controlling electrode;

a trigger means exciting said flash discharge tube to be conductive in response to a flash starting signal;

a switching device controlling means coupled between a power source and the controlling electrode for applying a controlling output to the controlling electrode of said first switching device independent of and before an exciting operation is initiated by said trigger means to make said first switching device conductive; and means for stopping application of the controlling output to the controlling electrode of said first switching device in response to a flash stopping signal and making said first switching device non-conductive.

50. A strobo apparatus comprising a boosting circuit including a power source, a main condenser charged by a boosted voltage from the boosting circuit, a flash discharge tube, a first switching device connected in series in a discharge path of said main condenser including said flash discharge tube, a trigger means applying a starting voltage to a trigger electrode of said flash discharge tube in response to a flash starting signal and exciting said flash discharge tube to be conductive, and a controlling means of said first switching device;

characterized in that said controlling means of said first switching device maintains said first switching device conductive in response to a conductive signal derived from a power source generated independently of and prior to initiation of a flash starting signal and making said first switching device non-conductive in response to a flash stopping signal.

51. A strobo flash controlling apparatus comprising:

a boosting circuit including a power source, said circuit producing a boosted power source voltage in response to an operating signal;

a main condenser charged by said boosting circuit;

a flash discharge tube having a trigger electrode;

a first switching device connected in series in a discharge path of said main condenser including said flash discharge tube;

said first switching device having a controlling electrode;

a trigger means for applying a starting voltage to a trigger electrode of the flash discharge tube in response to said flash starting signal and making said flash discharge tube conductive;

a voltage applying means coupled to a power source for applying a controlling voltage to a controlling electrode of said first switching device prior to initiation of and independently of a flash starting signal and maintaining the switching device conductive; and a voltage application stopping means stopping application of a controlling voltage to the controlling electrode of said first switching device in response to a flash stopping signal.

52. A strobo apparatus comprising:

a power source voltage boosting circuit;

a main condenser charged with a boosted voltage outputted by said power source voltage boosting circuit;

a series circuit connected in parallel with said main condenser and comprising a flash discharge tube and a first switching device of a gate-controlling type having a gate controlling electrode;

a trigger circuit for making said flash discharge tube conduct in response to a flash starting signal;

a bias circuit coupled to a power source for applying a bias voltage to the gate-controlling electrode of said first switching device and turning said first switching device on prior to and independently of initiation of a flash starting signal; and a second switching device connected to said gate controlling electrode, receiving a flash stopping signal and preventing voltage application by said bias circuit to said first switching device.

53. A strobo apparatus comprising a voltage boosting circuit including a power source, a main condenser charged by said voltage boosting circuit, a flash discharge tube, a gate-controlling type first switching device having a gate electrode and being connected in series in the discharge circuit of said main condenser including said flash discharge tube, a trigger means applying a starting voltage to a trigger electrode of said flash discharge tube in response to a flash starting signal to excite said discharge tube to be conductive and a gate electrode controlling means for controlling said first switching device;

characterized in that said gate electrode controlling means comprises:

a voltage applying means coupled directly across said main condenser for applying a divided voltage to the gate electrode of said first switching device to render said first switching device conductive prior to and independent of said flash starting signal; and a voltage application stopping means stopping the application of a voltage to the gate electrode of said first switching device responsive to a flash stopping signal.

* * * * *